US010622703B2

(12) United States Patent
Hong et al.

(10) Patent No.: US 10,622,703 B2
(45) Date of Patent: Apr. 14, 2020

(54) ANTENNA DEVICE AND ELECTRONIC DEVICE HAVING THE ANTENNA DEVICE

(71) Applicant: Samsung Electronics Co., Ltd., Gyeonggi-do (KR)

(72) Inventors: Won-Bin Hong, Seoul (KR); Yoon-Geon Kim, Busan (KR)

(73) Assignee: Samsung Electronics Co., Ltd (KR)

( * ) Notice: Subject to any disclaimer, the term of this patent is extended or adjusted under 35 U.S.C. 154(b) by 723 days.

(21) Appl. No.: 14/639,397

(22) Filed: Mar. 5, 2015

(65) Prior Publication Data

US 2015/0255856 A1 Sep. 10, 2015

(30) Foreign Application Priority Data

Mar. 5, 2014 (KR) ..... 10-2014-0026117
Dec. 3, 2014 (KR) ..... 10-2014-0172529

(51) Int. Cl.
*H01Q 1/24* (2006.01)
*H01Q 9/04* (2006.01)
(Continued)

(52) U.S. Cl.
CPC ..... *H01Q 1/243* (2013.01); *H01Q 1/44* (2013.01); *H01Q 9/0407* (2013.01); *H01Q 21/061* (2013.01)

(58) Field of Classification Search
CPC ..... H01Q 1/243; H01Q 9/0407; H01Q 1/44; H01Q 21/061; G06F 3/044
See application file for complete search history.

(56) References Cited

U.S. PATENT DOCUMENTS 6,933,891 B2 8/2005 Lange
7,983,721 B2 7/2011 Ying et al.
(Continued)

FOREIGN PATENT DOCUMENTS

CN 101180765 5/2008
CN 102308268 1/2012
(Continued)

OTHER PUBLICATIONS

International Search Report dated May 28, 2015 issued in counterpart application No. PCT/KR2015/002141.
(Continued)

*Primary Examiner* — Hai V Tran
*Assistant Examiner* — Michael M Bouizza
(74) *Attorney, Agent, or Firm* — The Farrell Law Firm, P.C.

(57) ABSTRACT

The present disclosure relates to a pre-5$^{th}$-Generation (5G) or 5G communication system to be provided for supporting higher data rates Beyond 4$^{th}$-Generation (4G) communication system such as Long Term Evolution (LTE).
An antenna device and an electronic device having the antenna device are provided. The antenna device includes a conductive film member including mesh grid areas formed by transparent wires and electrodes, and a radiation pattern path formed between the mesh grid areas. The electronic device includes a display including a touch panel, wherein the touch panel comprises a conductive film member including mesh grid areas formed by transparent wires and electrodes, and a radiation pattern path formed between the mesh grid areas.

12 Claims, 27 Drawing Sheets

(51) Int. Cl.
*H01Q 1/44* (2006.01)
*H01Q 21/06* (2006.01)

(56) References Cited

U.S. PATENT DOCUMENTS

| | | | | |
|---|---|---|---|---|
| 8,325,153 | B2 | 12/2012 | Rofougaran | |
| 2009/0051620 | A1 | 2/2009 | Ishibashi et al. | |
| 2010/0321325 | A1 | 12/2010 | Springer et al. | |
| 2011/0169770 | A1* | 7/2011 | Mishina | H01Q 7/00 345/174 |
| 2011/0273382 | A1* | 11/2011 | Yoo | H01Q 9/42 345/173 |
| 2011/0298670 | A1* | 12/2011 | Jung | H01Q 1/243 343/702 |
| 2012/0034888 | A1 | 2/2012 | De Flaviis | |
| 2012/0162032 | A1* | 6/2012 | Yang | H01Q 1/243 343/720 |
| 2012/0162128 | A1 | 6/2012 | Hyoung et al. | |
| 2013/0328732 | A1 | 12/2013 | Shimizu | |
| 2014/0016043 | A1 | 1/2014 | Chen et al. | |
| 2014/0028619 | A1 | 1/2014 | Huang et al. | |
| 2014/0045424 | A1 | 2/2014 | Fratti | |
| 2014/0113579 | A1 | 4/2014 | Li et al. | |

FOREIGN PATENT DOCUMENTS

| | | |
|---|---|---|
| CN | 102426492 | 4/2012 |
| CN | 102804106 | 11/2012 |
| CN | 103543486 | 1/2014 |
| EP | 1 868 263 | 12/2007 |
| EP | 2 416 443 | 2/2012 |
| JP | 2013-257755 | 12/2013 |
| KR | 1020130070247 | 6/2013 |
| WO | WO 2009/085777 | 7/2009 |

OTHER PUBLICATIONS

European Search Report dated Sep. 25, 2017 issued in counterpart application No. 15759089.4-1927, 7 pages.
Chinese Office Action dated May 11, 2018 issued in counterpart application No. 201580011841.5, 17 pages.
Chinese Office Action dated Jun. 13, 2019 issued in counterpart application No. 201580011841.5, 16 pages.
Chinese Rejection Decision dated Nov. 22, 2019 issued in counterpart application No. 201580011841.5, 16 pages.

* cited by examiner

ANTENNA DEVICE AND ELECTRONIC DEVICE HAVING THE ANTENNA DEVICE

PRIORITY

This application claims priority under 35 U.S.C. § 119(a) to a Korean Patent Application filed on Mar. 5, 2014 in the Korean Intellectual Property Office and assigned Serial No. 10-2014-0026117 and to a Korean Patent Application filed in the Korean Intellectual Property Office on Dec. 3, 2014 and assigned Serial No. 10-2014-0172529, the entire contents of which are incorporated herein by reference.

BACKGROUND

1. Field of the Invention

The present invention relates generally to an electronic device, and more particularly, to an antenna device configured to implement wireless communication functionality and an electronic device having the antenna device.

2. Description of the Related Art

Wireless communication technologies have recently been implemented in various manners including a Wireless Local Area Network (WLAN) implemented mainly by Wireless Fidelity (WiFi), Bluetooth, Near Field Communication (NFC), and the like, as well as to provide access to commercialized mobile communication networks. As mobile communication networks have evolved from the $1^{st}$ Generation (1G) focusing on voice calls to the $4^{th}$ Generation (4G), mobile communication services now enable provisioning of the Internet and multimedia services. It is expected that a future-generation commercialized mobile communication service will be provided in an ultra high frequency band of tens of GHz or higher.

To meet the demand for wireless data traffic which has increased since the deployment of $4^{th}$-Generation (4G) communication systems, efforts have been made to develop an improved $5^{th}$-Generation (5G) or pre-5G communication system. Therefore, the 5G or pre-5G communication system is also called a "Beyond 4G Network" or a "Post LTE System."

The 5G communication system is considered to be implemented in higher frequency (e.g. mmWave) bands, e.g., 60 GHz bands, so as to accomplish higher data rates. To decrease propagation loss of the radio waves and increase the transmission distance, beamforming, massive Multiple-Input Multiple-Output (MIMO), Full Dimensional MIMO (FD-MIMO), array antenna, analog beam forming, and large scale antenna techniques are discussed in 5G communication systems.

In addition, in 5G communication systems, development for system network improvement is under way based on advanced small cells, cloud Radio Access Networks (RANs), ultra-dense networks, Device-to-Device (D2D) communication, wireless backhaul, moving network, cooperative communication, Coordinated Multi-Points (CoMP), reception-end interference cancellation and the like.

In the 5G system, Hybrid Frequency Shift Keying FSK and Feher's Quadrature Amplitude Modulation (FQAM) and Sliding Window Superposition Coding (SWSC) as an Advanced Coding Modulation (ACM), and Filter Bank Multi Carrier (FBMC), Non-Orthogonal Multiple Access (NOMA), and Sparse Code Multiple Access (SCMA) as an advanced access technology have been developed.

As communication standards such as WLAN and Bluetooth have become more prominent, an electronic device, for example, a mobile communication terminal, is equipped with an antenna device operating in various frequency bands. For example, a 4G mobile communication service is provided in frequency bands of 700 MHz, 1.8 GHz, and 2.1 GHz, WiFi is implemented in frequency bands of 2.4 GHz and 5 GHz although the frequency bands are different according to the communication standards, and Bluetooth is implemented in a frequency band of 2.45 GHz.

Commercialized electronic devices such as a TV and a large-sized electronic device have larger screens due to the scale-down of the bezel areas. As a bezel area gets smaller, a screen gets larger for a small-sized electronic device like a portable terminal. To provide a stable service quality at higher data rates in a commercialized wireless communication network, while enabling wireless communication with various external devices, an antenna device of an electronic device should provide a high gain and a wide beam coverage. Considering that a future-generation mobile communication service will be provided in a high frequency band of tens of GHz or higher, higher performance may be required for an antenna device than an antenna device used for a legacy commercial mobile communication service. For example, although a radio signal in a higher frequency band can deliver a larger amount of information faster, the radio signal may be reflected from or blocked by an obstacle and has a shorter propagation distance, because as the frequency band becomes higher, the radio signal becomes more linear.

If a plurality of antenna modules is installed, wireless signals may be transmitted and received in various frequency bands. However, the number of installed antenna modules is limited due to a limited installation space of the antenna modules. Particularly, it is difficult to secure a mounting space and position for ensuring stable performance for antenna modules in a portable small-sized electronic device with a reduced bezel area.

FIG. 1 illustrates electronic devices each having an antenna device, FIG. 2 is a schematic view illustrating the numbers of antenna devices in electronic devices and radio frequency states according to the numbers of antenna devices, and FIG. 3 is a graph illustrating data transmission capacity or channel capacity according to the number of antenna devices in an electronic device.

Referring to FIGS. 1A-1C, 2, and 3, each electronic device 10 is equipped with at least one antenna device for transmitting data to and receiving data from external devices. Currently, when the electronic device 10 is provided with a display 30, the antenna device is installed in a part of the periphery of the display 30 called a Bezel Area (BA) 20 to thereby prevent the display 30 from degrading the radiation performance of the antenna device. In contrast, if the electronic device 10 is a large-sized TV, the antenna device is installed in the BA 20 of the electronic device 10, but in the rear surface of the electronic device 10. If the electronic device 10 is a TV used at a fixed position and the antenna device is mounted on the rear surface of the electronic device 10, radio waves of the antenna device are reflected from or absorbed into a wall or the like behind the rear surface of the electronic device 10, thus degrading transmission and reception performance.

If the electronic device 10 is a portable terminal, the antenna device is provided in BAs 20 defined at the top and bottom parts of the display 30. However, like a TV, as the display 30 occupies more area of the electronic device 10, the BAs 20 become smaller. As a result, the mounting space of the antenna device is reduced, as illustrated in FIG. 1.

In addition, the electronic device 10 such as a TV or a portable terminal has recently been equipped with a plurality of antenna devices to conduct wireless communication in various communication schemes and transmit data to and receive data from an external device quickly in various radio frequencies.

Wireless communication is conducted using one antenna device in Single Input Single Output (SISO), a plurality of antenna devices at a transmitter and a single antenna device at a receiver in Multiple Input Single Output (MISO), or a plurality of antenna devices at each of a transmitter and a receiver in Multiple Input Multiple Output (MIMO), depending on the numbers of antenna devices deployed at a transmitter and a receiver, as illustrated in FIG. 2. It may be noted from FIG. 3 that the data rate of an electronic device having a MIMO antenna device, that is, more antenna devices, is increased.

As described above, the size and shape of the electronic device 10 are designed in a manner that limits the mounting space and position of the antenna device. Nonetheless, the electronic device 10 is required to transmit increasing amounts of data more quickly.

There is a need for an antenna device having a high gain and a wide radiation coverage in a future-generation wireless communication service, as stated above. Also, along with the trend of increasing screen sizes, the installation space of an antenna device configured to radiate signals forward is getting smaller. When the antenna device is installed at a different position, it is difficult to secure antenna radiation performance.

Moreover, it is difficult for antenna devices to provide stable transmission and reception performance in an ultra high frequency band in an electronic device equipped with various antenna devices operating by WiFi, Bluetooth, NFC, and the like, as well as by mobile communication.

SUMMARY

The present invention has been made to address at least the above-mentioned problems and/or disadvantages, and to provide at least the advantages described below. Accordingly, an aspect of the present invention is to provide an antenna device having a high gain and a wide radiation coverage and an electronic device having the antenna device.

Another aspect of the present invention is to provide an antenna device which can be readily installed and offers stable performance even in an electronic device having a small size or a reduced bezel area.

Another aspect of the present invention is to provide an antenna device which is readily installed in a small-sized electronic device such as a mobile communication terminal or which has stable radiation performance in an electronic device such as a TV which has a large display and a minimized bezel area.

Another aspect of the present invention is to provide an antenna device implemented in various manners in a display.

In accordance with an aspect of the present invention, there is provided an antenna device. The antenna device includes a conductive film member including mesh grid areas formed by transparent wires and electrodes, and a radiation pattern path formed between the mesh grid areas.

In accordance with another aspect of the present invention, there is provided an electronic device having an antenna device. The electronic device includes a display including a touch panel, wherein the touch panel includes a conductive film member including mesh grid areas formed by transparent wires and electrodes, and a radiation pattern path formed between the mesh grid areas.

In accordance with another aspect of the present invention, there is provided an electronic device. The electronic device includes a display including a touch panel, and an antenna panel stacked in the display, wherein the antenna panel includes a conductive film member including mesh grid areas, and a radiation pattern path formed between the mesh grid areas in a part of the conductive film member for forming at least one radiation pattern.

In accordance with another aspect of the present invention, there is provided an antenna device configured in a display. The antenna device includes a dielectric layer provided in the display, an antenna area formed on a front or rear surface of the dielectric layer for transmitting or receiving electromagnetic waves through a plurality of conductive grids, a conductive area disposed apart from the antenna area by a predetermined distance on a plane on which the antenna area is formed and including the plurality of conductive grids, and a dielectric area disposed between the antenna area and the conductive area for separating the antenna area from the conductive area by the predetermined distance by removing the conductive grids.

In accordance with another aspect of the present invention, there is provided an electronic device. The electronic device includes a touch panel stacked in a display, and an antenna unit stacked on or under the touch panel or on a surface of the touch panel in the display for transmitting or receiving electromagnetic waves through at least one antenna area having a plurality of conductive grids.

BRIEF DESCRIPTION OF THE DRAWINGS

The above and other aspects, features and advantages of the present invention will be more apparent from the following description, taken in conjunction with the accompanying drawings, in which.

DETAILED DESCRIPTION OF EMBODIMENTS OF THE PRESENT INVENTION

Figures 1A, 1B, 1C:
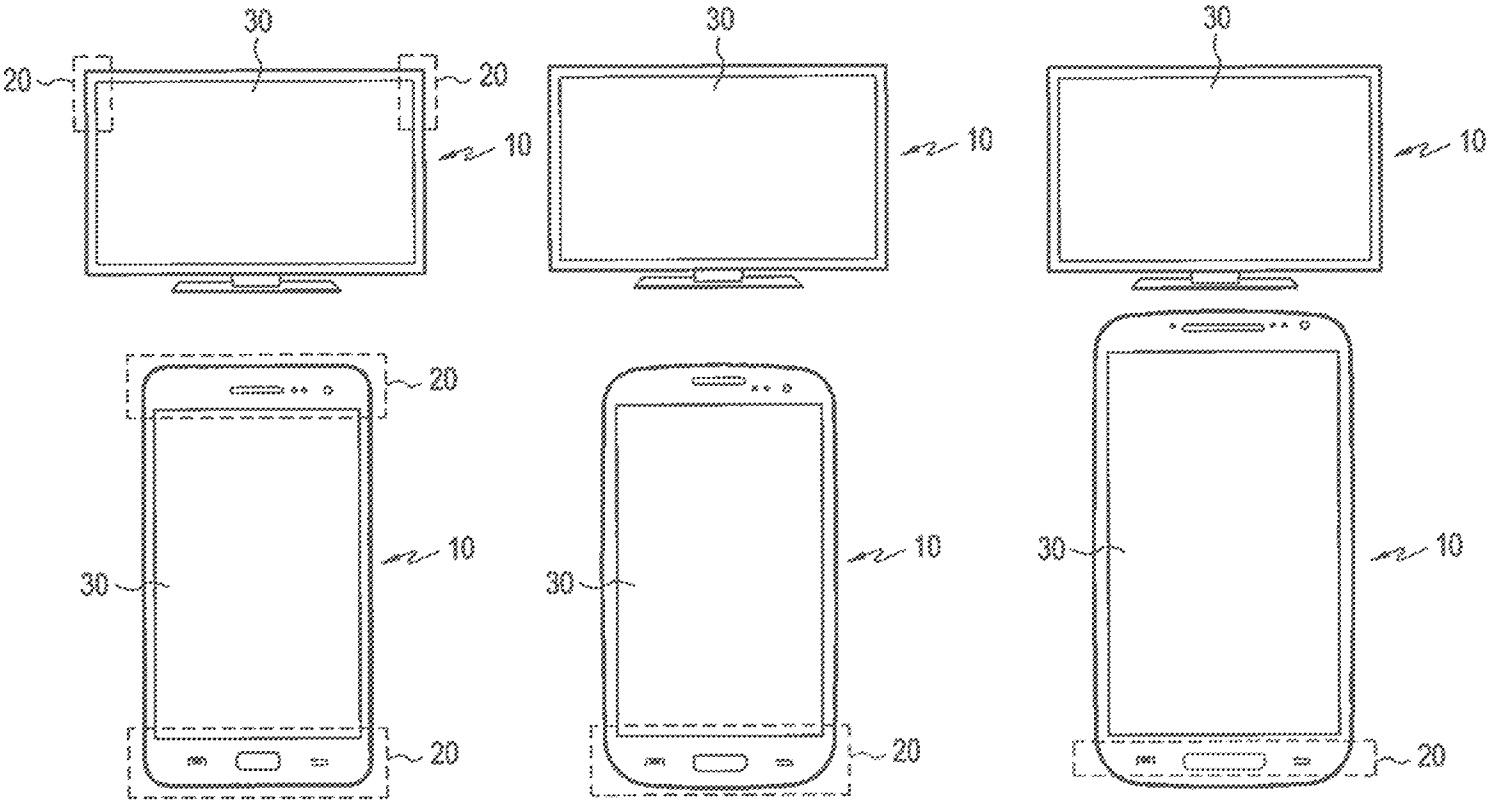
FIG. 1A (PRIOR ART)
FIG. 1B (PRIOR ART)
FIG. 1C (PRIOR ART)
FIGS. 1A-1C illustrate electronic devices each having an antenna device.
Figure 2:
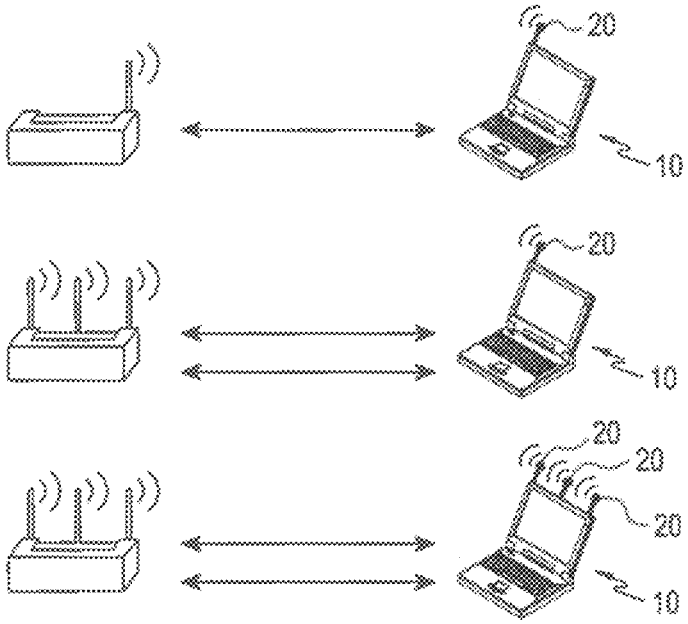
FIG. 2 is an illustration of different numbers of antenna devices in different electronic devices and corresponding radio frequency transmission and reception states according to the different numbers of antenna devices.
Figure 3:
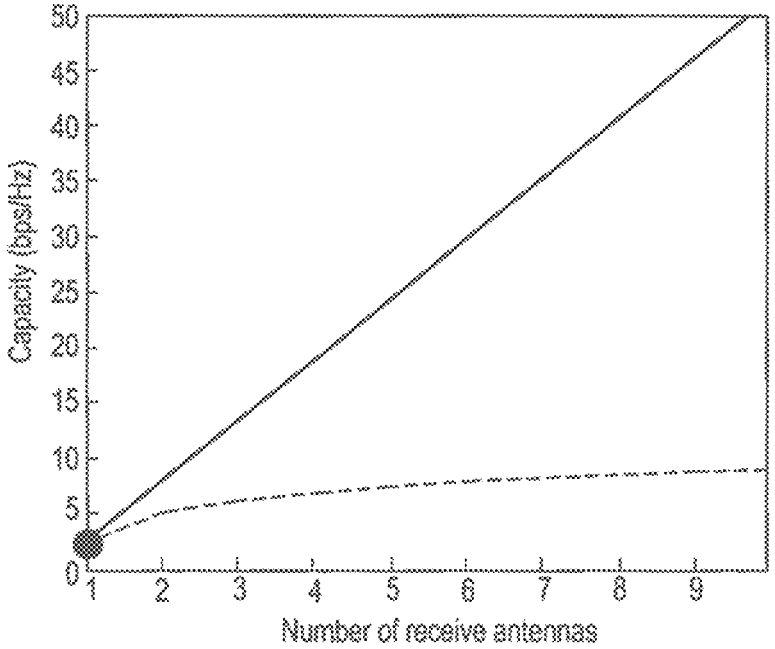
FIG. 3 is a graph illustrating data transmission capacity or channel capacity according to the number of antenna devices in an electronic device.

Various embodiments of the present invention are described with reference to the attached drawings. As the present invention allows for various changes and numerous embodiments, embodiments are illustrated in the drawings and described in detail below. However, the present invention is not limited to the embodiments and should be construed as including all the changes, equivalents, and/or substitutions included in the scope and spirit of the present invention. Like reference numerals denote the same components in the drawings.

As used in an embodiment of the present invention, terms such as "includes" or "may include" refer to the presence of a disclosed corresponding function, operation, or component, and do not limit the presence of one or more additional functions, operations, or components. Also, terms such as "includes" or "has" refer to the presence of characteristics, numbers, steps, operations, components, parts, or combinations thereof, and are not intended to exclude one or more additional characteristics, numbers, steps, operations, components, parts or combinations thereof.

As used in an embodiment of the present invention, the term "or" is used to include any and all combinations of terms listed. For example, "A or B" includes only A, only B, or both A and B.

As used in an embodiment of the present invention, terms such as "first" or "second" may be used to describe various components, but do not limit such components. For example, the terms do not limit the order and/or the importance of their associated components. Such terms may be used to distinguish one component from another. If a component is said to be "connected with" or "connected to" another component, the component may be directly connected with, or directly connected to, the other component, or another component may exist in between. In contrast, if a component is said to be "directly connected with" or "directly connected to" another component, it should be understood that no components exist in between.

Terms used in an embodiment of the present invention are used to describe the embodiment of the present invention, and are not intended to limit the present invention. Singular terms are intended to include plural forms, unless the context makes it clear that plural forms are not intended.

Unless defined otherwise, all terms used in the present invention, including technical or scientific terms, have meanings that are understood generally by a person having ordinary skill in the art. Ordinary terms that may be defined in a dictionary should be understood to have meanings consistent with their context, and unless clearly defined in the present invention, should not be interpreted to be excessively idealistic or formalistic.

Figure 4:
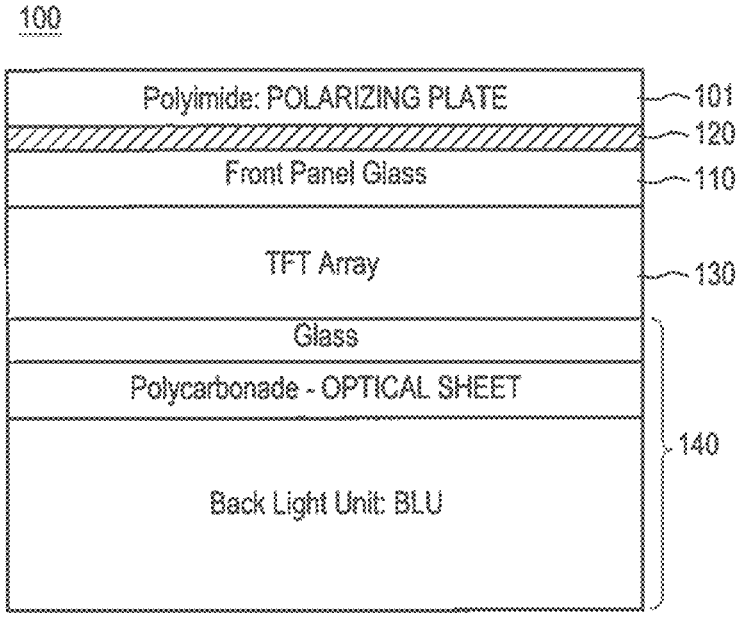
FIG. 4 is a sectional view illustrating a display having a built-in antenna device according to an embodiment of the present invention.

FIG. 4 is a sectional view illustrating a display having a built-in antenna device according to an embodiment of the present invention, and FIGS. 5A to 5D illustrate a conductive film member having a radiation pattern path according to an embodiment of the present invention.

Figure 5A:
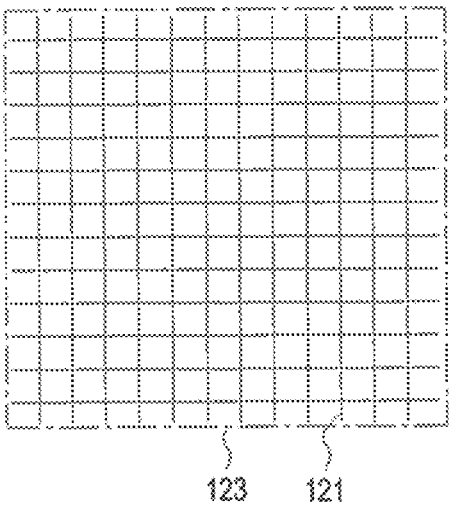
FIGS. 5A to 5D illustrate a conductive film member having a radiation pattern path in an antenna device according to an embodiment of the present invention.
Figure 5B:
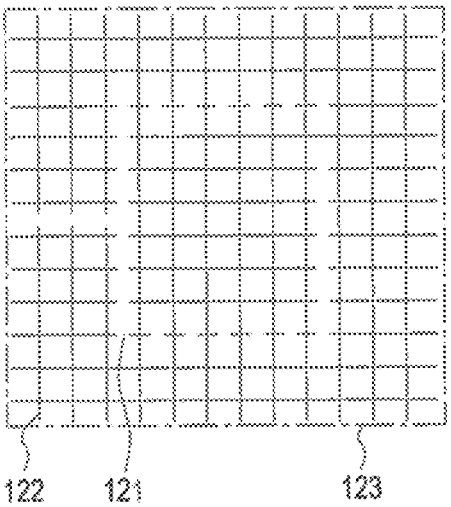
Figure 5C:
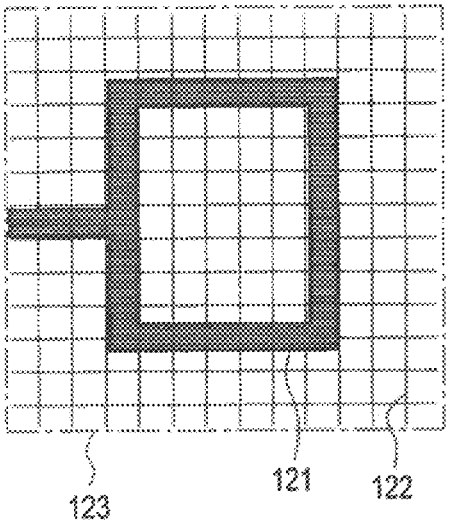
Figure 5D:
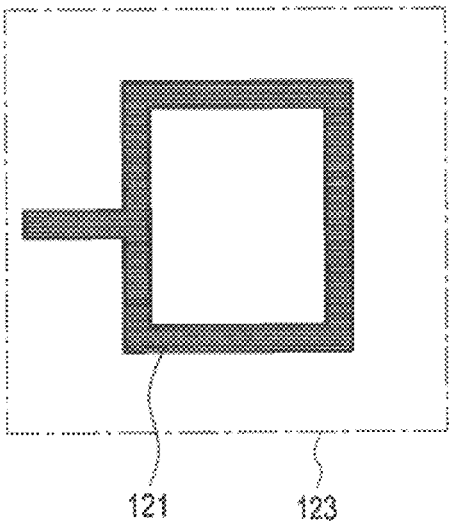

Referring to FIGS. 4 to 5D, in order to realize a screen, an electronic device according to an embodiment of the present invention includes a display 100 in which a plurality of modules, for example, a Back Light Unit (BLU), a glass panel, and a touch panel are stacked. The display 100 may include one of panels formed of various materials into various shapes, such as a Liquid Crystal Display (LCD) panel, a Light Emitting Diode (LED) panel, an Organic Light Emitting Diode (OLED) panel, and an Active Matrix Organic Light Emitting Diode (AMOLED) panel, according to imaging schemes. According to an embodiment of the present invention, the display 100 with a stacked LED or LCD panel structure will be described by way of example. However, the display 100 may include one of the afore-described many other panels.

In the stack structure of the display 100 according to an embodiment of the present invention, a lower panel 140 with a BLU, an optical sheet, and a rear glass panel is placed on the bottom of the display 100, for example, a Thin Film Transistor (TFT) array 130 is stacked on the lower panel 140, a touch panel 120 is stacked on the TFT array 130 to sense contact on an upper panel 110, a polarizing plate 101 such as a polyimide plate is provided on the touch panel 120, and the glass panel 110 is provided on the front or rear surface of the touch panel 120. The touch panel 120 senses contact of an object having an electric charge. A part of a conductive film member 123 in the touch panel 120 may be used as a radiator of the antenna device, for example, as a radiation pattern path 121, so that the antenna device may be built at least partially in the display 100.

For example, the touch panel 120 may include mesh grid areas 122 formed by transparent wires and electrodes and the conductive film member 123 on which the mesh grid areas 122 are defined. The mesh grid areas 122 on the conductive film member 123 are defined by partially removing mesh grids formed by wires on the touch panel 120 using the radiation pattern path 121. The conductive film member 123 may include an Indium Tin Oxide (ITO) panel.

One or more radiation pattern paths 121 are formed between mesh grid areas 122 and form predetermined antenna radiation patterns by receiving a signal current from a power supply 125. The radiation pattern paths 121 are provided on at least a part of the conductive film member 123, for example, in the proximity of a substrate 160 in FIG. 6 connected to the display 100. As described above, the radiation pattern paths 121 are formed by removing a part of transparent wires and electrodes on the conductive film member 123 in the form of radiation patterns. The radiation pattern paths 121 may form patch-type radiation patterns by removing a part of the mesh grid areas 122 in the form of the radiation patterns. Alternatively, the radiation pattern paths 121 may form at least one of a slot-type, loop-type, monopole-type, and dipole-type radiation pattern. In an embodiment of the present invention, the radiation pattern paths 121 may be located in a part of the conductive film member 123, for example, in the proximity of an edge of the conductive film member 123. The radiation pattern paths 121 may be arranged linearly in a direction parallel to the edge. One or more radiation pattern paths 121 may be arranged as illustrated in FIGS. 7A to 7D.

As more radiation pattern paths 121 are provided on the conductive film member 123, a data rate or capacity may be increased. For example, if 16 radiation pattern paths 121 can be arranged in a 20 mm×20 mm area, about 24×12 radiation pattern paths 121 may be arranged in a portable terminal of about 120 mm×60 mm.

Such a radiation pattern path 121 has a predetermined width. Thus, when a signal current is applied to the radiation pattern path 121 through the power supply 125, a magnetic current is generated in the radiation pattern path 121, for example between adjacent mesh grid areas 122 with the radiation pattern path 121 in between and thus the radiation pattern path 121 may act as a radiator. Further, adjacent radiation pattern units 121 may receive a signal current and have a predetermined operating frequency wavelength according to the electrical length of the signal current. Accordingly, an operating frequency may be determined according to the width d1 of a radiation pattern path 121 between mesh grid areas 121, the distance d2 between adjacent radiation pattern paths 121, and/or the path length 1 of the radiation pattern path 121. For example, an operating frequency or a resonant frequency λ and impedance matching may be achieved according to the number of radiation pattern paths 121, the length of the array of the radiation pattern paths 121, and a power supply position. In general, the operating frequency of an antenna device is set based on the physical and electrical lengths of a radiation pattern, the distance between the radiation pattern and another radiation pattern, and the width of the radiation pattern. According to an embodiment of the present invention, a radiation pattern of an antenna device is formed by radiation pattern paths 121. Once the resonant frequency λ of the radiation pattern is determined, the path length 1 of a radiation pattern path 121 is determined by Equation (1):

$$L = N \times \frac{\lambda}{4} \tag{1}$$

where L represents the width d1, interval d2, or path length 1 of the radiation pattern path 121, N is a natural number, and λ represents the resonant frequency of the radiation pattern. In Equation (1), N may be set appropriately according to an electronic device in which the antenna device will be mounted. For an electronic device configured for mobile communication, the antenna device may be designed to have an electrical length of λ/4. According to an embodiment of the present invention, the resonant frequency λ of the radiation pattern and impedance matching may be achieved in various manners using the width d1 of each radiation pattern path 121 or the interval d2 between radiation pattern paths 121.

Figure 6:
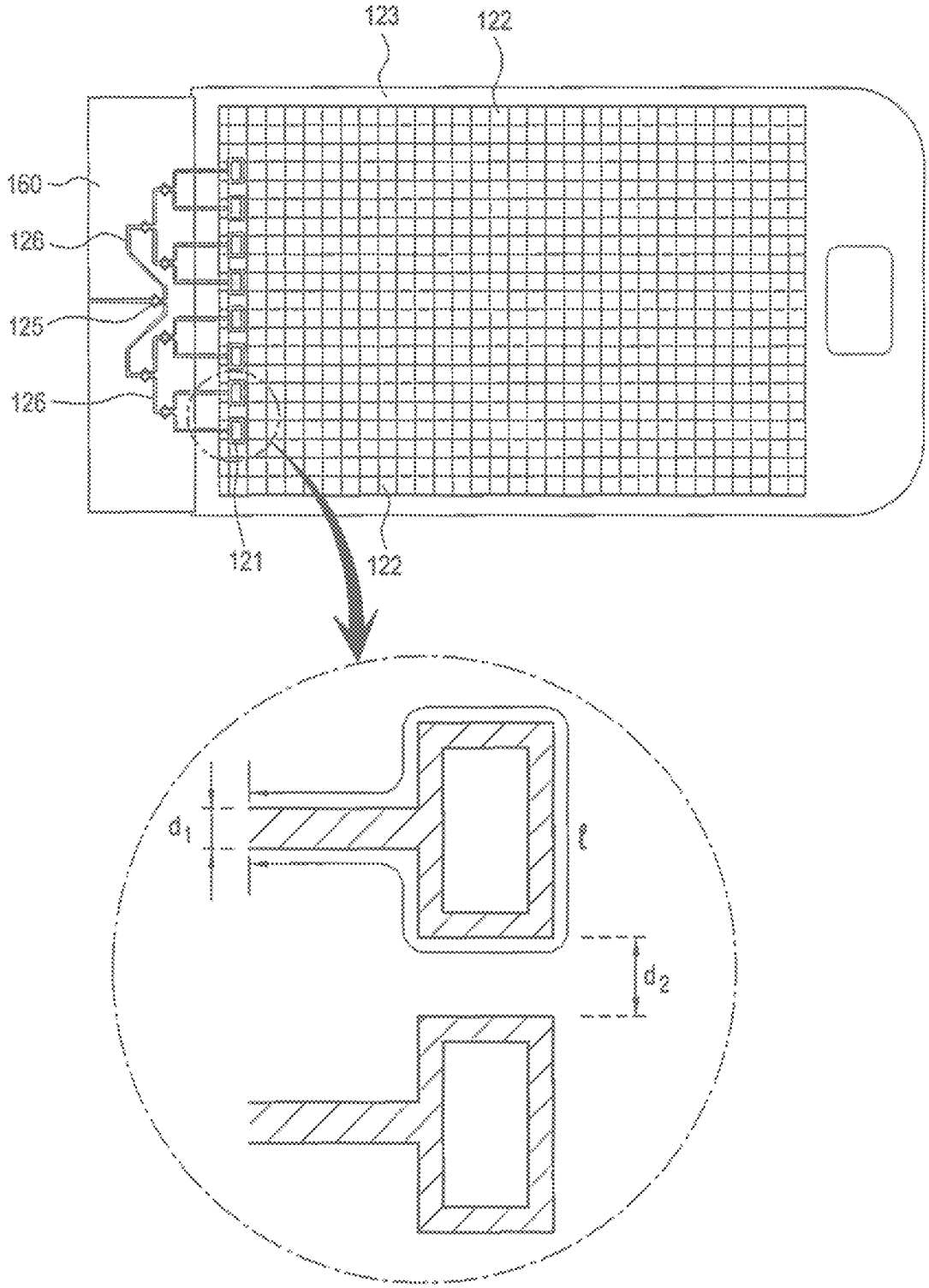
FIG. 6 illustrates an electronic device having an antenna device according to an embodiment of the present invention.

FIG. 6 illustrates the display 100 having radiation pattern paths 121 according to an embodiment of the present invention.

Referring to FIG. 6, the power supply 125 and a transmission line unit 126 may be provided to apply a signal current to the radiation pattern paths 121. The power supply 125 may be disposed on the substrate 160 electrically connected to the display 100 at an edge of the display 100. The power supply 125 and the transmission line unit 126 may be formed of a conductor material, such as, copper, in order to apply a signal current to the radiation pattern paths 121.

Figure 7A:
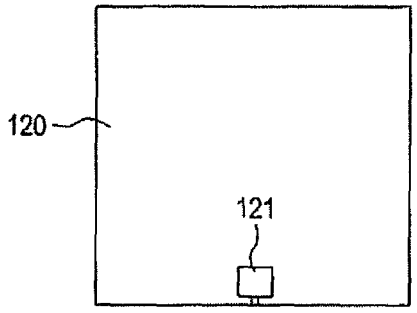
FIGS. 7A to 7E illustrate radiation pattern paths in a display and a graph illustrating antenna radiation efficiency with respect to a number of radiation pattern paths according to an embodiment of the present invention.
Figure 7C:
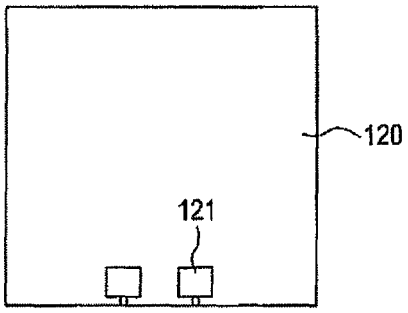
Figure 7B:
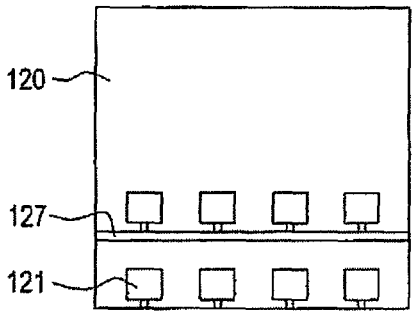
Figure 7D:
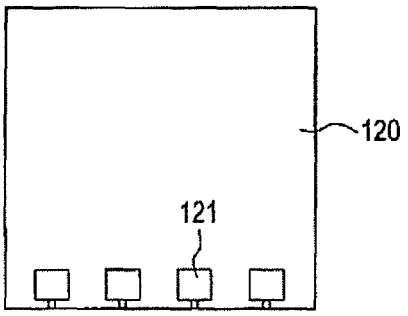
Figure 7E:
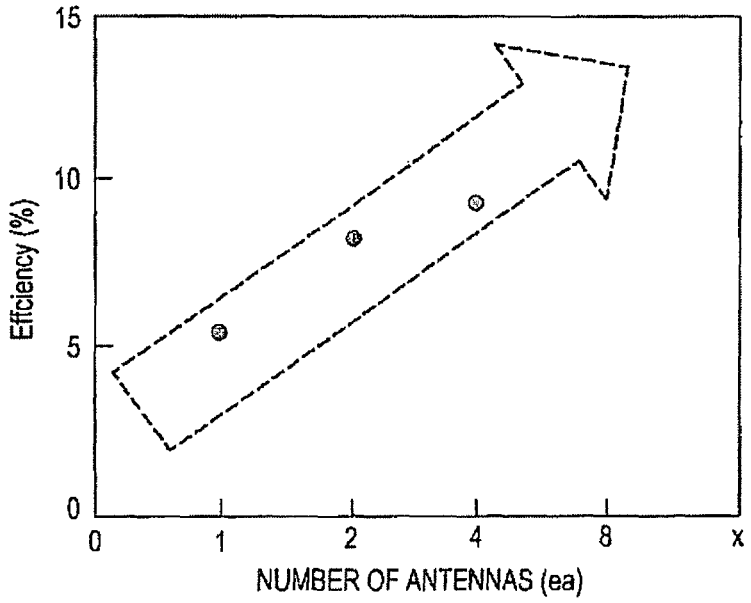

FIGS. 7A to 7D illustrate radiation pattern paths on a display and FIG. 7E is a graph illustrating antenna radiation efficiency with respect to a number of radiation pattern paths according to an embodiment of the present invention.

Referring to FIG. 7A, a single radiation pattern path 121 may be formed at a side of the conductive film member 123. As described above, a plurality of radiation pattern paths 121 may be arranged along an edge of the conductive film member 123. If a plurality of radiation pattern paths 121 are arranged as in FIG. 7C, a power supply line 127 parallel to an edge of the conductive film member 123 may apply a signal current to each radiation pattern path 121. Referring to FIG. 7E, it is noted that as more radiation pattern paths 121 are formed in a partial area of the conductive film member 123, antenna radiation efficiency is increased. In other words, as more radiation pattern paths 121 are formed in a part of the mesh grid areas 122 for the touch panel 120, antenna radiation efficiency may be increased for data transmission and reception of the electronic device. This is because an increase in the number of radiation pattern paths 121 leads to an increase in the magnitude of a magnetic current on the whole. However, it should be understood that the magnitude of the magnetic current is not always proportional to the number of radiation pattern paths 121. For example, the proportional relationship between the number of radiation pattern paths 121 and the magnitude of the magnetic current may be more or less different depending on the resonant frequency band of the antenna device including the radiation pattern paths 121.

Figures 16A, 16B:
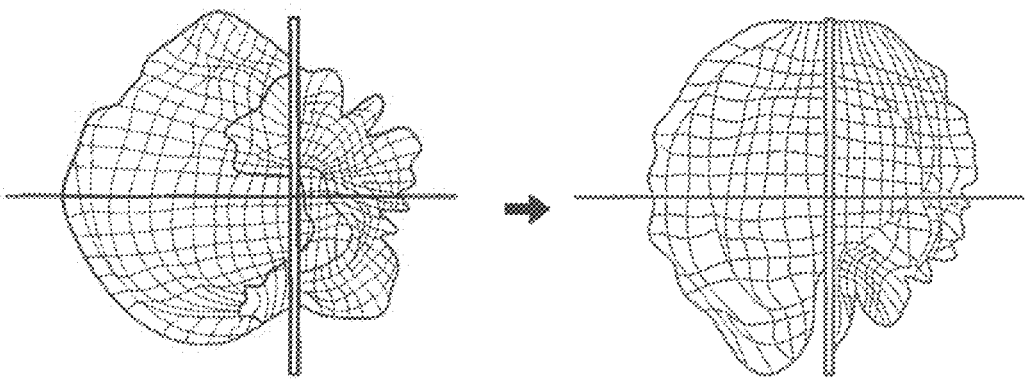
FIGS. 16A and 16B illustrate radiation patterns of antenna devices built into a display.

Because the radiation pattern paths 121 are arranged in a part of the conventional touch panel 120, the above-described antenna device built in the display 100 may be readily mounted without the need for additional space and may increase design freedom in arranging other circuit devices of the electronic device. Further, the antenna device may provide a radiation pattern independently of an antenna module provided in the electronic device and the whole radiation pattern of the antenna device may be formed three-dimensionally in up, down, left, and right directions. For example, in the case of an electronic device having an antenna device mounted only on its rear surface, radiation performance through the front surface of the electronic device may be increased by at least 13 dB, as illustrated in FIGS. 16A and 16B. Therefore, an electronic device used at a fixed location, such as a TV, may achieve stable transmission and reception performance and have a high gain and a wide radiation coverage.

Furthermore, if the antenna device according to an embodiment of the present invention is installed, the display 100 may be increased in size in an electronic device of the same size and the BA 20 may be scaled down. Thus design freedom and design enhancement may be achieved.

Referring to FIGS. 8 to 16, a stack structure for an antenna device built in a display 200 in an electronic device according to an embodiment of the present invention is described below.

In regard to the difference between display 100 described above and display 200 described below, the radiation pattern paths 121 for transmission and reception are provided on the conductive film member 123 of the touch panel 120, which is one of the components of the display 100. In contrast, an antenna panel 250 is stacked separately from the touch panel 220 that senses contact. Thus, radiation pattern paths 252 are stacked on a touch panel 220, on one surface of a conductive film member 221 (hereinafter, referred to as a second conductive film member 221) being a component of the touch panel 220. For the same components as in the electronic device described above, the foregoing description is referred to.

Figure 8:
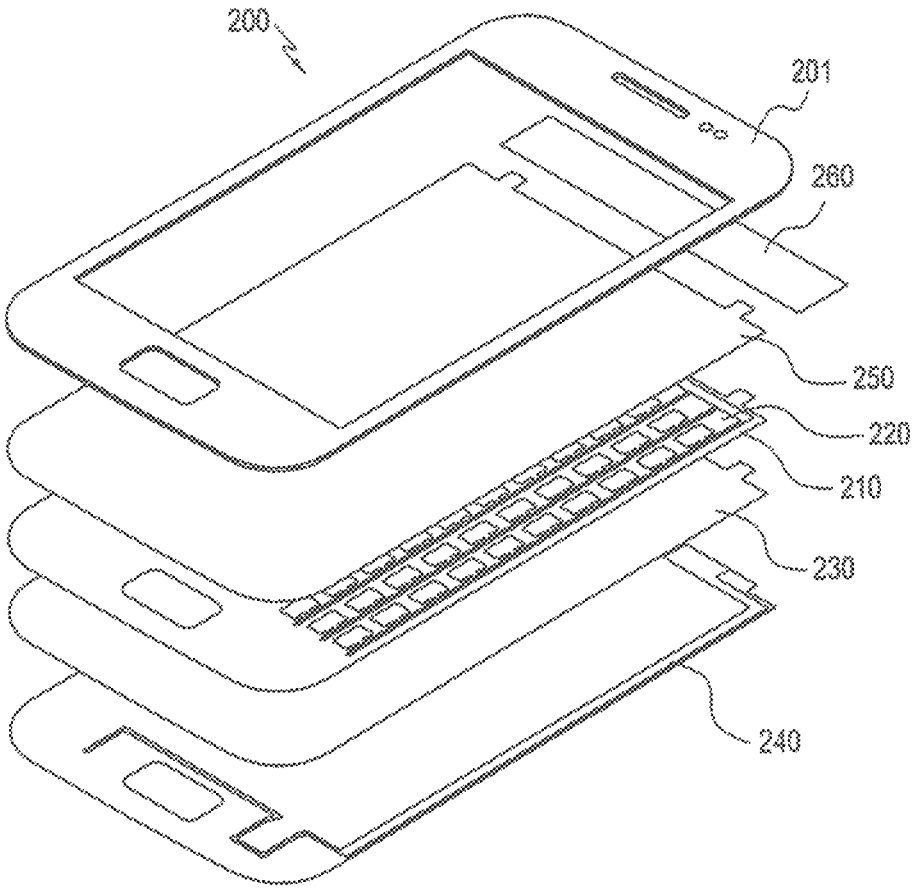
FIG. 8 illustrates an electronic device having an antenna device according to an embodiment of the present invention.
Figure 9A:
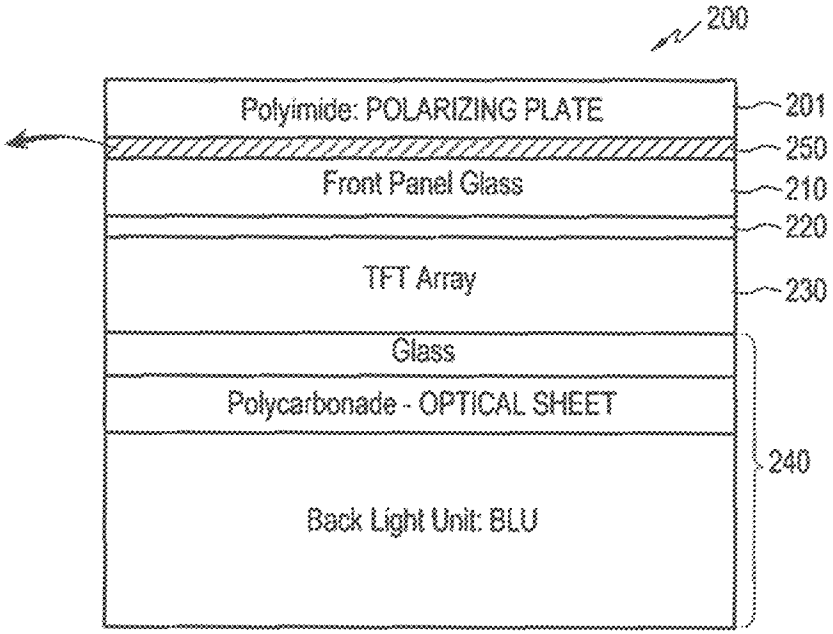
FIGS. 9A and 9B are sectional views illustrating a stack state of a display according to an embodiment of the present invention.
Figure 9A:
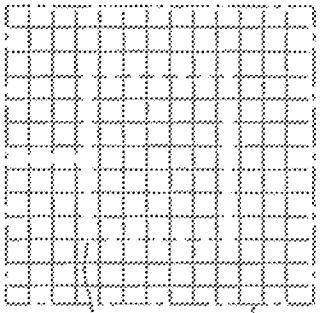
Figure 9B:
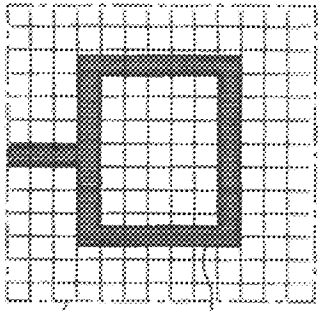

FIG. 8 illustrates an electronic device having an antenna device according to an embodiment of the present invention, and FIGS. 9A and 9B are sectional views illustrating a stacked state of a display according to an embodiment of the present invention.

Referring to FIGS. 8 to 9B, the antenna panel 250 may be stacked on one surface of the display 200 having a built-in antenna device according to the present invention. For example, the antenna panel 250 may include a transparent conductive film member 251 and one or more radiation pattern paths 252 that form a radiation pattern, between mesh grid areas 253 formed by transparent wires and electrodes on the conductive film member 251. The conductive film member 251 including the radiation pattern paths 252 is stacked on one surface of the touch panel 220 of the display 200. Thus, the antenna device is built in the display 200, separately from the configuration of the touch panel 220.

According to an embodiment of the present invention, the touch panel 220 is described as an ITO panel, by way of example. A glass panel 210 may be stacked on the ITO panel, covering the ITO panel. The antenna panel 250 may be stacked to be built in the display 200 in two methods. One of the methods is that the antenna panel 250 is stacked on the front surface of the touch panel 220 as in the embodiment of the present invention and the other method is that the antenna panel 250 is stacked on the rear surface of the touch panel 220. From the perspective of the antenna panel 250, if radiation is implemented through the radiation pattern paths 252 of the antenna panel 250, the second conductive film member 221 of the touch panel 220 may be configured as a ground panel of the radiation pattern paths 252 in which a signal current flows. While the glass panel 210 is described as interposed between the antenna panel 250 and the ITO panel in the embodiment of the present invention, it should not be construed as limiting the present invention. For example, the antenna panel 250 may be stacked facing the ITO panel and the glass panel 210 may be stacked on the stacked panels. Thus, many variations or modifications can be made to the stack structure.

Figure 10:
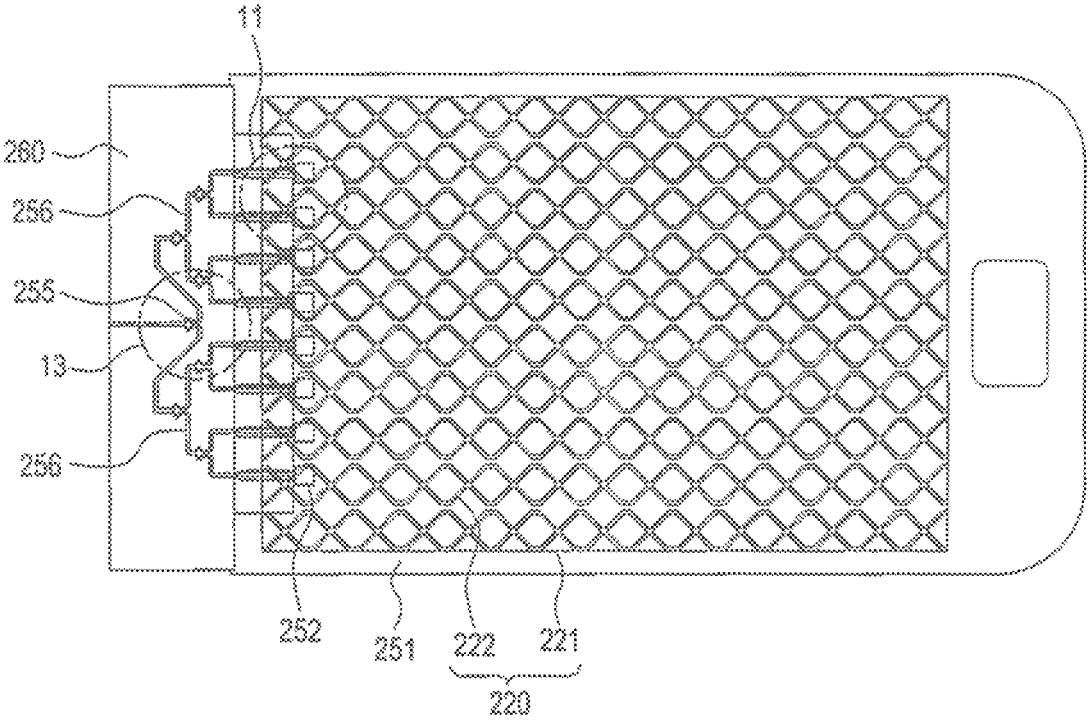
FIG. 10 illustrates a conductive film member of an antenna device stacked on a touch panel according to an embodiment of the present invention.
Figure 11:
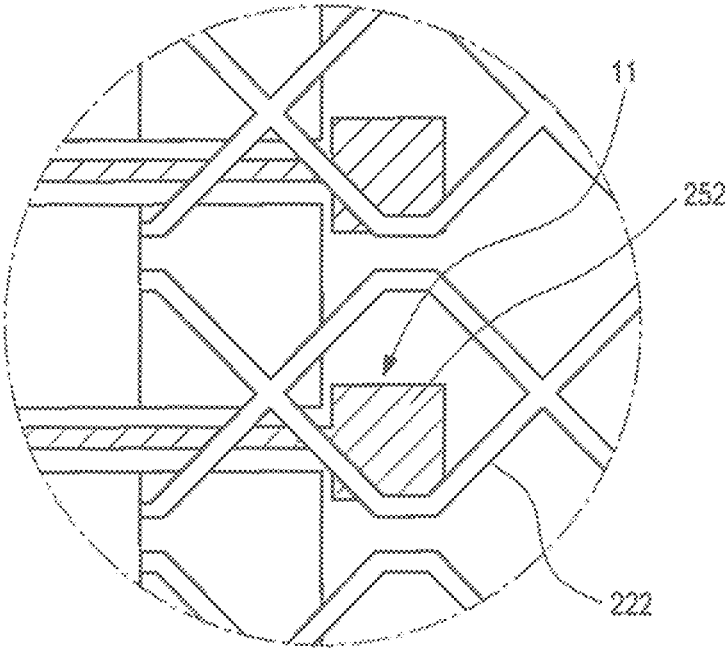
FIG. 11 is a partial view of FIG. 10.
Figure 12:
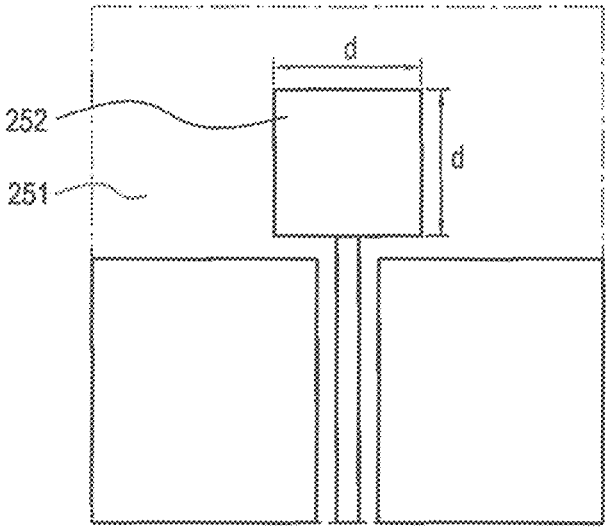
FIG. 12 is a partial view of a radiation pattern path illustrated in FIG. 11.
Figure 13:
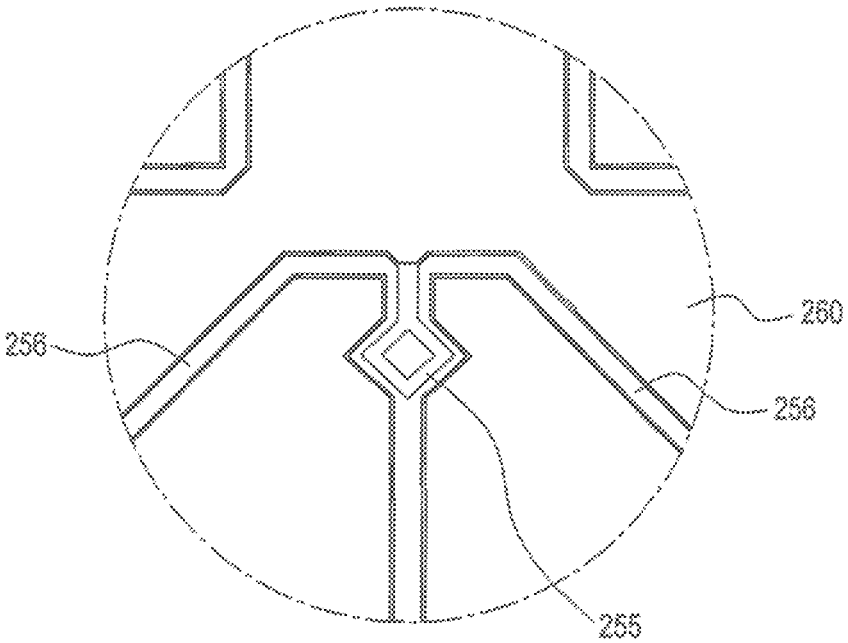
FIG. 13 is a partial view of FIG. 10.
Figure 14:
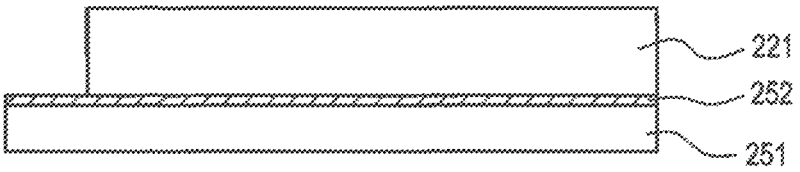
FIG. 14 is a sectional view illustrating a substrate and the radiation pattern path illustrated in FIG. 10.

FIG. 10 illustrates a conductive film member of an antenna device stacked on a touch panel according to an embodiment of the present invention, and FIG. 11 is a partial view of FIG. 10. FIG. 12 is a partial view of a radiation pattern path illustrated in FIG. 10, FIG. 13 is a partial view of FIG. 10, and FIG. 14 is a sectional view illustrating a substrate 260 and the radiation pattern path illustrated in FIG. 10.

Referring to FIGS. 10 to 14, the antenna panel 250 is built in the display 200, as a separate structure from the touch panel 220, as stated above. A mesh grid pattern 222 is distributed over the second conductive film member 221 of the touch panel 220, for sensing contact. The mesh grid pattern 222 is formed using conductive wires. Therefore, if the mesh grid pattern 222 is overlapped with the radiation pattern paths 252, the radiation performance of the radiation pattern paths 252 may be degraded. For example, if the antenna panel 250 is stacked on the rear surface of the touch panel 220, the mesh grid pattern 222 of the touch panel 220 affects antenna radiation performance even though a signal current flows in the radiation pattern paths 252 and thus forms a frequency band. Accordingly, the radiation pattern paths 252 of the antenna panel 250 are positioned with an offset with respect to the mesh grid pattern 222 of the touch panel 220. For example, the radiation pattern paths 252 are provided in an empty space of the mesh grid pattern 222 so as to prevent overlap between the radiation pattern paths 252 and the mesh grid pattern 222.

For example, when the antenna panel 250 is stacked on the rear surface of the touch panel 220, mesh grid areas of the conductive film member 251 are partially removed in correspondence to an empty space of the mesh grid pattern 222 so that the radiation pattern paths 252 may be disposed with an offset with respect to the mesh grid pattern 222 of the touch panel 220. Consequently, even though the radiation pattern paths 251 are stacked on the touch panel 220, the mesh grid pattern 222 does not affect the radiation performance of the radiation pattern paths 252 because the radiation pattern paths 252 are positioned in an empty space of the mesh grid pattern 222 formed on the touch panel 220.

The radiation pattern paths 252 are formed by removing mesh grids in a part of the conductive film member 251 into a radiation pattern so that a signal current from the power supply 125 may flow through the radiation pattern paths 252. Therefore, the radiation pattern paths 252 act as radiators by receiving the signal current.

Figure 15:
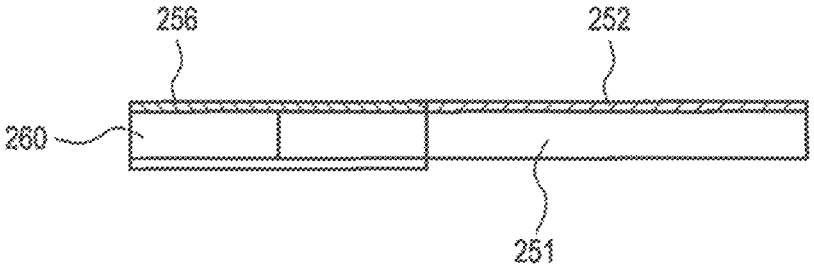
FIG. 15 is a sectional view illustrating a substrate and the radiation pattern path illustrated in FIG. 10.

FIG. 15 is an enlarged view of FIG. 13. Referring to FIG. 15, a substrate, a power supply, and a transmission line unit are identical to their counterparts described above in the display 100 and thus are not described in detail herein. The substrate 260 may be provided at at least one edge of the touch panel 220 and the radiation pattern paths 252 are disposed on the conductive film member 251, in the proximity of the substrate 260. A power supply 255 and a transmission line unit 256 are provided on the substrate 260 to apply a signal current to the radiation pattern paths 252. Thus when the touch panel 220 and the antenna panel 250 are stacked, the touch panel 220 may be connected electrically to the substrate 260 and the antenna panel 250 may be connected electrically to the power supply 255 and the transmission line unit 256.

As described above, the display 200 having the built-in antenna device may have a number of radiation pattern paths 252 in a part of the conductive film member 251 and when a signal current flows in the radiation pattern paths 252, the magnitude of a magnetic current increases, thereby increasing antenna radiation efficiency, as illustrated in FIG. 7E. If the display 200 having the above antenna device is provided in an electronic device, an area required for mounting an antenna device may be decreased and other circuit devices may be arranged with increased design freedom because the antenna device is built in the display 200.

FIGS. 16A and 16B illustrate radiation patterns for an antenna device built into a display.

Referring to FIGS. 16A and 16B, since an independent radiation function is implemented in a display, separately from an antenna module provided in an electronic device, a 3D radiation pattern may be formed in up, down, left, and right directions on the whole in the electronic device. For example, a comparison between a radiation pattern of a conventional antenna device mounted only on the rear surface of an electronic device having the above configuration in FIG. 16A and a radiation pattern of a radiation pattern path 252 in the display 200 in FIG. 16B reveals that the latter may increase radiation performance from the front surface of the electronic device by at least 13 dB. As a result, the electronic device may achieve a high gain and a wide radiation coverage as well as a stable transmission and reception performance.

As is apparent from the foregoing description of an antenna device and the electronic device having the same according to an embodiment of the present invention, since an antenna device having radiation performance is built as one component in a display of the electronic device, a plurality of antenna devices may be mounted in a limited space. As the plurality of antenna devices are configured, data transmission and reception rates and efficiency are increased in the electronic device. Further, as the antenna devices can be provided on the front surface of the electronic device, an area required for installing the antenna devices can be decreased and other circuit devices can be arranged with increased design freedom in the electronic device.

In addition, since an antenna device having radiation performance is built as a component in a display of the electronic device, a plurality of antenna devices may be mounted in a limited space. As the plurality of antenna devices are configured, data transmission and reception rates and efficiency are increased in the electronic device. Further, since the antenna device can be provided on the front surface of the electronic device, a forward radiation property in a frequency band of tens of GHz or higher can be achieved. As radiation pattern paths are arranged in at least one line on a conductive film member, a conventional substrate of the display can be used efficiently.

A description is now given of an antenna device 350 configured internally to a display 300 and an electronic device having the antenna device 350 according to an embodiment of the present invention with reference to FIGS. 17 to 46. The antenna device 350 may be stacked in the display 300 in a similar structure to the stack structure described above. Accordingly, for the same configurations or operations of the antenna device 350 and the electronic device having the same as described above, the foregoing description will be referred to.

The antenna device 350 is configured internally to the display 300 according to an embodiment of the present invention, as described above. The antenna device 350 may be disposed on the same panel as a touch panel 320 or on a different panel (e.g. a dielectric layer 351 referred to as a second conductive film member in the foregoing embodiment of the present invention) from the touch panel 320.

Figure 17:
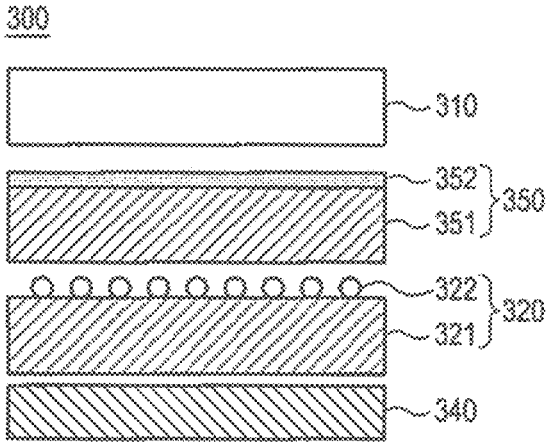
FIG. 17 illustrates an antenna device stacked on a touch panel according to an embodiment of the present invention.
Figure 18:
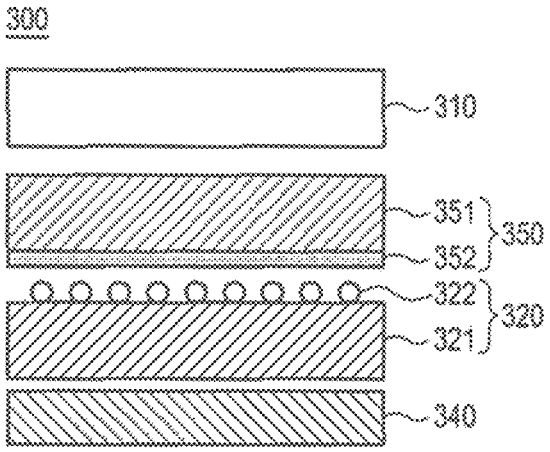
FIG. 18 illustrates an antenna device stacked on a touch panel according to an embodiment of the present invention.
Figure 19:
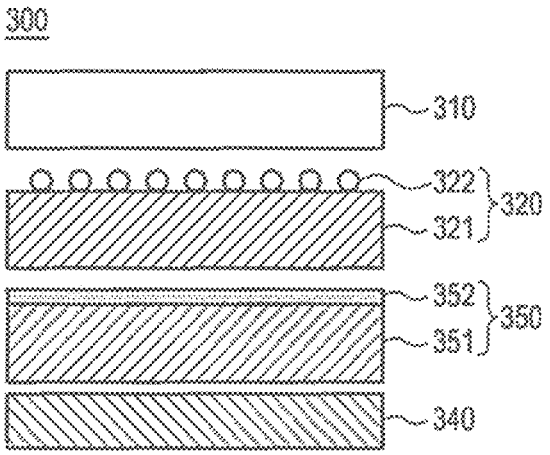
FIG. 19 illustrates an antenna device stacked under a touch panel according to an embodiment of the present invention.
Figure 20:
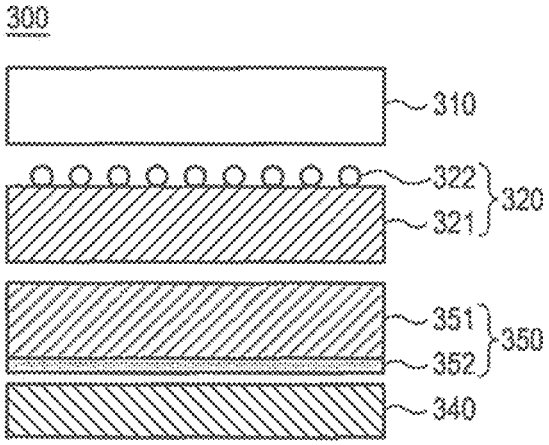
FIG. 20 illustrates an antenna device stacked under a touch panel according to an embodiment of the present invention.
Figure 21:
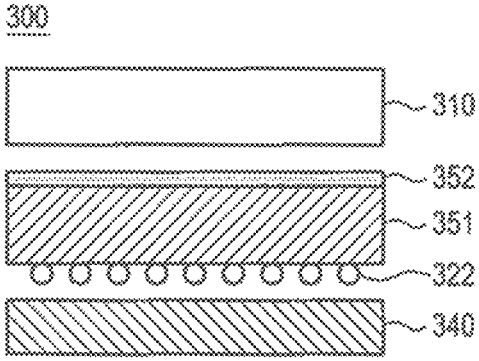
FIG. 21 illustrates a display in which mesh grids and an antenna area are formed together on a dielectric layer according to an embodiment of the present invention.
Figure 22:
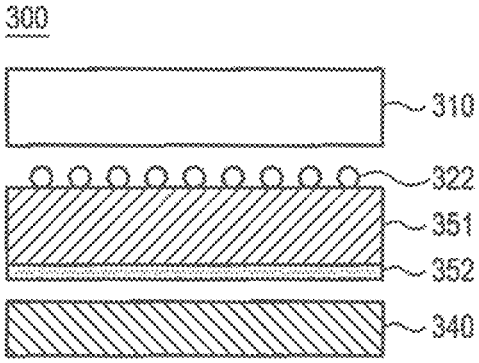
FIG. 22 illustrates a display in which mesh grids and an antenna area are formed together on a dielectric layer according to an embodiment of the present invention.
Figure 27:
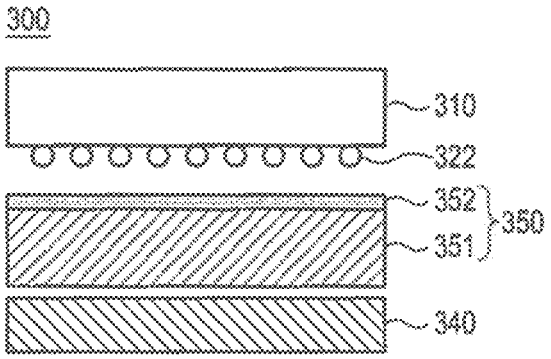
FIG. 27 illustrates a display in which mesh grids are formed on a glass and an antenna device is stacked under the glass having the mesh grids according to an embodiment of the present invention.
Figure 28:
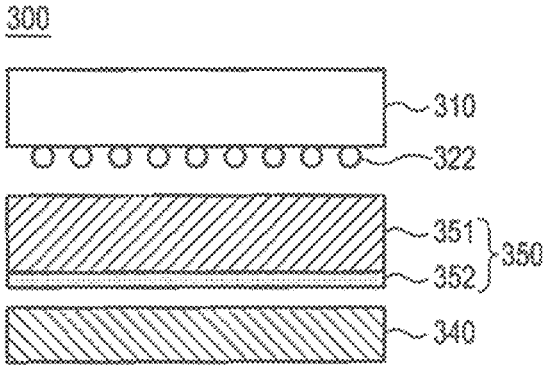
FIG. 28 illustrates a display in which mesh grids are formed on a glass and an antenna device is stacked under the glass having the mesh grids according to an embodiment of the present invention.
Figure 29:
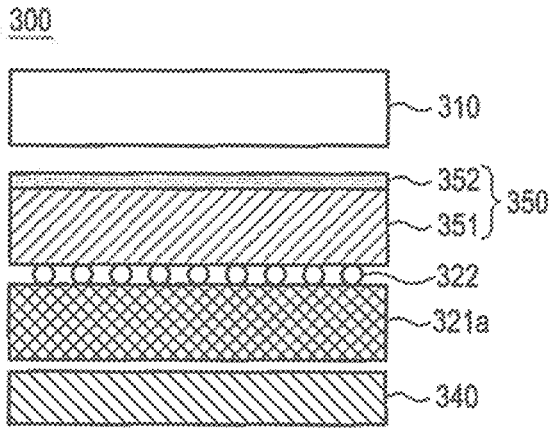
FIG. 29 illustrates a display in which a touch panel includes an On-Cell TSP AMOLED (OCTA) panel wherein an antenna device and the touch panel are stacked according to an embodiment of the present invention.
Figure 30:
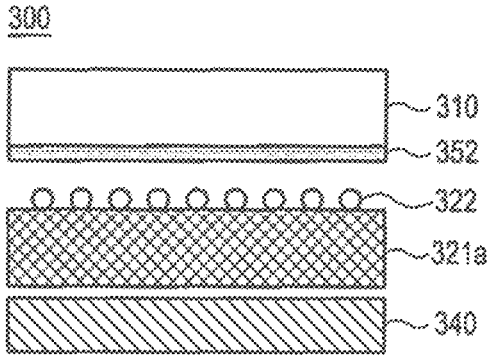
FIG. 30 illustrates a display in which a touch panel includes an On-Cell TSP AMOLED (OCTA) panel wherein an antenna device and the touch panel are stacked according to an embodiment of the present invention.
Figure 31:
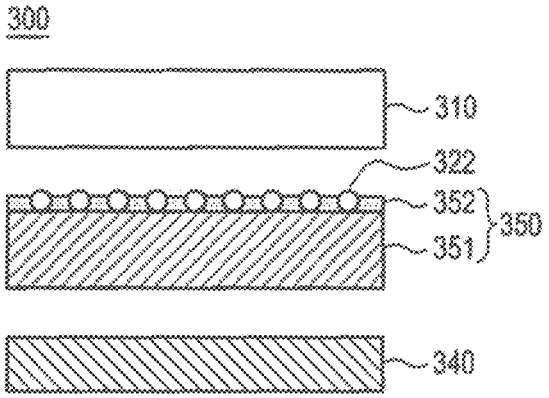
FIG. 31 illustrates a display in which an antenna area and mesh grids are formed on a plane according to an embodiment of the present invention.
Figure 32:
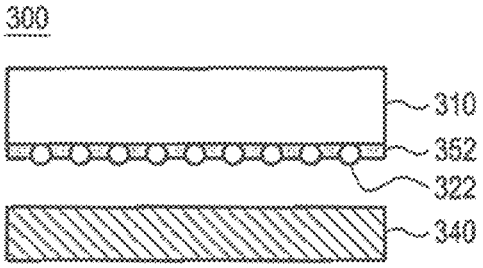
FIG. 32 illustrates a display in which an antenna area and mesh grids are formed on a plane according to an embodiment of the present invention.
Figure 33:
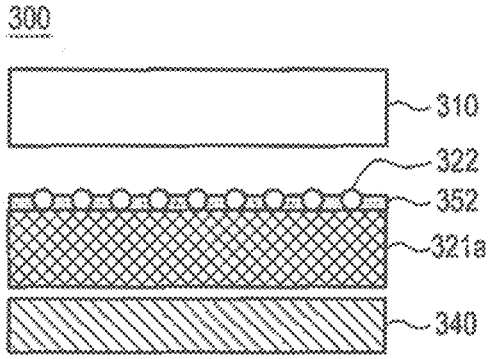
FIG. 33 illustrates a display in which an antenna area and mesh grids are formed on a plane according to an embodiment of the present invention.

FIGS. 17 to 33 are views illustrating positions of the antenna device 350 in the display 300 according to various embodiments of the present invention. For example, FIGS. 17 and 18 illustrate the antenna device 350 disposed on the touch panel 320, FIGS. 19 and 20 illustrate the antenna device 350 disposed under the touch panel 320, FIGS. 21 and 22 illustrate the antenna device 350 disposed on the top and bottom surfaces of the touch panel 320, respectively, FIGS. 23 to 26 illustrate the antenna device 350 configured on a glass 310, FIGS. 27 and 28 illustrate the touch panel 320 configured on the glass 310 and the antenna device 350 disposed under the glass 310, FIGS. 29 and 30 illustrate the touch panel 320 configured as an OCTA panel and the antenna device 350 disposed on the OCTA panel, and FIGS. 31, 32, and 33 illustrate patterns of the touch panel 320 and the antenna device 350 disposed on the same plane. FIG. 17 illustrates the antenna device 350 configured internally to the display 300 according to an embodiment of the present invention.

Figure 34:
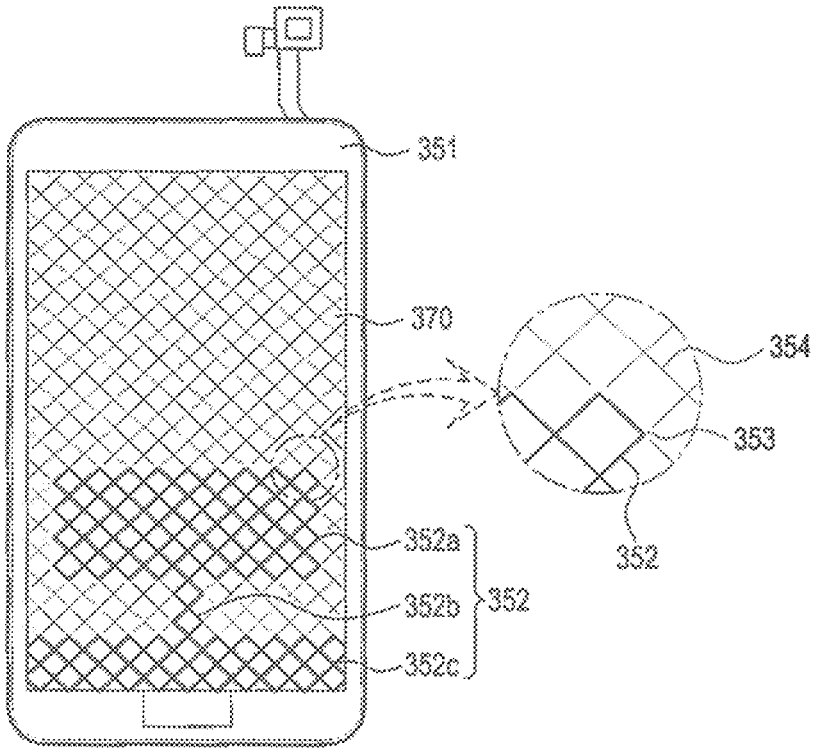
FIG. 34 is an antenna device according to an embodiment of the present invention.

Referring to FIGS. 17 to 33 (along with FIGS. 4 and 5), the antenna device 350 may be configured internally to the display 300. The antenna device 350 and the touch panel 320 may be disposed on the same panel or different panels. The antenna device 350 may include an antenna area 352, a conductive area 354, and a dielectric area 353 as illustrated in FIG. 34 and collectively referred to as an antenna pattern 355 and 352. According to an embodiment of the present invention, the antenna pattern 355 and 352 of the antenna device 350 and mesh grids 322 of the touch panel 320 may be provided on different panels. In contrast, the antenna pattern 355 and 352 of the antenna device 350 and the mesh grids 322 of the touch panel 320 may be provided on the same panel.

If the antenna pattern 355 and 352 of the antenna device 350 and the mesh grids 322 of the touch panel 320 are stacked on different panels, the antenna pattern 355 and 352 may be provided on the dielectric layer 351 illustrated in FIG. 17, and the mesh grids 322 of the touch panel 320 may be provided on a second dielectric layer 351 (including a conductive film member 321 or an OCTA panel, hereinafter referred to as the conductive film member 321) other than the dielectric layer 351. If the antenna pattern 355 and 352 and the mesh grids 322 are provided on different panels, the dielectric layer 351 having the antenna pattern 355 and 352 may be disposed on or under the conductive film member 321 or the OCTA panel on which the mesh grids 322 are formed.

Alternatively, the mesh grids 322 of the touch panel 320 may be provided on the conductive film member 321 or the OCTA panel, whereas the antenna pattern 355 and 352 may be disposed on one or the other surface of the glass 310 placed on the conductive film member 321. In contrast, the antenna pattern 355 and 352 may be provided on the dielectric layer 351, whereas the mesh grids 322 of the touch panel 320 may be disposed on one or the other surfaces of the glass 310.

If the antenna device 350 and the touch panel 320 are stacked on the same panel, the antenna pattern 355 and 352 and the mesh grids 322 may be disposed on the top and bottom surfaces of the dielectric layer 351, respectively, or on the same surface of the dielectric layer 351.

The antenna device 350 may include the antenna area 352, the conductive area 354, and the dielectric area 353, as illustrated in FIG. 34. The antenna area 352 may be provided on at least one of the top and bottom surfaces of the dielectric layer 351, the glass 310, or the conductive film member 321 of the touch panel 320 so that the antenna area 352 may be placed on or under the mesh grids 322 or at the same position as the mesh grids 322.

The antenna area 352 may be provided on the front or rear surface of the dielectric layer 351 and may transmit or receive electromagnetic waves through a plurality of conductive grids.

The conductive area 354 is provided on the same plane as the antenna area 352. The conductive area 354 may be disposed apart from the antenna area 352 by a predetermined distance and may include a plurality of conductive grids. The conductive area 354 may include dummy grids, may be formed as a ground, may secure visibility, or may secure distances between patterns of radiators 352*a* of the antenna area 352, as described below with reference to FIG. 34.

The dielectric area 353 is defined between the antenna area 352 and the conductive area 354. As the plurality of conductive grids is removed for the dielectric area 353, the antenna area 352 and the conductive area 354 may be spaced by the predetermined distance.

The antenna area 352, the conductive area 354, and the dielectric area 353 may coexist on one or the other surface of the dielectric layer 351, the glass 310, or the conductive film member 321.

While it is described according to an embodiment of the present invention by way of example that the antenna area 352, the conductive area 354, and the dielectric area 353 coexist on one or the other surface of the dielectric layer 351, the glass 310, or the conductive film member 321, this should not be construed as limiting the present invention. In other words, only the antenna area 352 may be formed on one or the other surface of the dielectric layer 351, the glass 310, or the conductive film member 321. Although the following description is given with the appreciation that only the antenna area 352 is formed on one or the other surface of the dielectric layer 351, the glass 310, or the conductive film member 321, those skilled in the art will clearly understand that the antenna area 352 may coexist with the conductive area 354 and the dielectric area 353.

As stated above, the touch panel 320 is provided in the display 300 in order to sense a proximity or a contact touch. The touch panel 320 may be stacked separately from the antenna device 350 in the display 300. Alternatively, the touch panel 320 may be provided on the same plane as or on a different plane from the dielectric layer 351 having the antenna area 352. If the touch panel 320 is stacked separately from the antenna device 350 in the display 300, the touch panel 320 may be provided on or under the antenna device 350, thus on a different plane from the antenna device 350. The mesh grids 322 of the touch panel 320 may be provided on the dielectric layer 351 being a panel on which the antenna area 352, for example the antenna area 352 and the conductive area 354, are formed. Even in this case, the mesh grids 322 and the antenna area 352 may be disposed on the same plane of the dielectric layer 351 or different planes of the dielectric layer 351.

As described above, the touch panel 320, for example the mesh grids 322, may be disposed on the front or rear surface of the dielectric layer 351 and thus on the same plane or a different plane from the antenna area 352. Alternatively, the mesh grids 322 may be disposed on the front or rear surface of the conductive film member 321 provided on or under the dielectric layer 351.

The display 300 may further include a display panel 340 and the glass 310. The display panel 340 may include the lower panel 140 having a BLU on the bottom, an optical sheet, and a rear glass panel, the TFT array 130, and the polarizing plate 101 formed of, for example, polyimide as illustrated in FIG. 9A.

The glass 310 may be disposed on and/or under the dielectric layer 351. Depending on the shape, structure, or configuration of the display 300, the antenna area 352 or the mesh grids 322 may be provided on the glass 310.

Various embodiments of stacking the antenna device 350 and the touch panel 320 in the display 300 are described below in detail with reference to FIGS. 17 to 33.

FIG. 17 illustrates an antenna device stacked on a touch panel according to an embodiment of the present invention and FIG. 18 illustrates an antenna device stacked on a touch panel according to an embodiment of the present invention.

Referring to FIGS. 17 and 18, the display 300 may be configured so that the antenna device 350 is stacked on the touch panel 320 according to an embodiment of the present invention. For example, the display panel 340 may be placed at the bottom, the glass 310 may be placed at the top, and the touch panel 320 and the antenna device 350 may be stacked sequentially between the display panel 340 and the glass 310.

The touch panel 320 stacked on the display panel 340 may include the conductive film member 321 and the mesh grids 322 formed on at least one surface of the conductive film member 321. While the mesh grids 322 are described as provided on the top surface of the conductive film member 321 by way of example in the embodiment of the present invention, the mesh grids 322 may be provided on the bottom surface of the conductive film member 321.

The conductive film member 321 having the mesh grids 322 may be stacked on the display panel 340. The dielectric layer 351 on which the antenna area 352, for example the antenna area 352, the conductive area 354, and the dielectric area 353 are formed, may be stacked on the top surface of the conductive film member 321 having the mesh grids 322. The antenna area 352 may be defined on the top surface of the dielectric layer 351, as illustrated in FIG. 17 or on the bottom surface of the dielectric layer 351, as illustrated in FIG. 18.

In the stack structure of the antenna device 350 and the touch panel 320 according to the embodiment of the present invention illustrated in FIG. 17, the antenna device 350 is placed on the touch panel 320. For example, the display panel 340, the conductive film member 321 with the mesh grids 322 on it, the dielectric layer 351 with the antenna area 352 on it, and the glass 310 may be sequentially stacked.

In the stack structure of the antenna device 350 and the touch panel 320 according to the embodiment of the present invention illustrated in FIG. 18, the antenna device 350 is placed on the touch panel 320. For example, the display panel 340, the conductive film member 321 with the mesh grids 322 on it, the dielectric layer 351 with the antenna area 352 on its bottom surface, and the glass 310 may be sequentially stacked.

FIG. 19 illustrates an antenna device stacked under a touch panel 320 according to an embodiment of the present invention and FIG. 20 illustrates an antenna device stacked under a touch panel 320 according to an embodiment of the present invention.

Referring to FIGS. 19 and 20, the display 300 may be so configured that the antenna device 350 is stacked under the touch panel 320 according to an embodiment of the present invention. For example, the display panel 340 may be placed at the bottom, the glass 310 may be placed at the top, and the antenna device 350 and the touch panel 320 may be stacked sequentially between the display panel 340 and the glass 310.

The touch panel 320 stacked on the antenna device 350 may include the conductive film member 321 and the mesh grids 322 formed on at least one surface of the conductive film member 321. While the mesh grids 322 are described as provided on the top surface of the conductive film member 321 by way of example in the embodiment of the present invention, the mesh grids 322 may be provided on the bottom surface of the conductive film member 321.

For example, the dielectric layer 351 having the antenna area 352 formed on it may be stacked on the display panel 340. The antenna area 352 may be defined on the top surface of the dielectric layer 351, as illustrated in FIG. 19 or on the bottom surface of the dielectric layer 351, as illustrated in FIG. 20.

The touch panel 320 may be stacked on the dielectric layer 351. As described above, the touch panel 320 may include the conductive film member 321 and the mesh grids 322 formed on the top or bottom surface of the conductive film member 321. While the mesh grids 322 are described as provided on the top surface of the conductive film member 321 by way of example in the embodiment of the present invention, the mesh grids 322 may be provided on the bottom surface of the conductive film member 321.

In the stack structure of the antenna device 350 and the touch panel 320 according to the embodiment of the present invention illustrated in FIG. 19, the display panel 340, the dielectric layer 351, the antenna area 352, the conductive film member 321, the mesh grids 322, and the glass 310 may be sequentially stacked.

In the stack structure of the antenna device 350 and the touch panel 320 according to the embodiment of the present invention illustrated in FIG. 20, the display panel 340, the antenna area 352, the dielectric layer 351, the conductive film member 321, the mesh grids 322, and the glass 310 may be sequentially stacked.

FIG. 21 illustrates a display in which an antenna area 352 and mesh grids 322 are provided together in one dielectric layer 351 according to an embodiment of the present invention, and FIG. 22 illustrates a display in which an antenna area 352 and mesh grids 322 are provided together in one dielectric layer 351 according to an embodiment of the present invention.

Referring to FIGS. 21 and 22, the display 300 according to an embodiment of the present invention may be configured so that the antenna device 350 and the touch panel 320 are stacked in the same panel. For example, the antenna area 352 and the mesh grids 322 may be provided on different surfaces of one panel. In an embodiment of the present invention, the display panel 340 and the glass 310 may be stacked and a panel (e.g. the dielectric layer 351) having the antenna area 352 and the mesh grids 322 may be stacked between the display panel 340 and the glass 310 in the display 300.

According to the embodiment of the present invention illustrated in FIG. 21, the mesh grids 322 may be formed on the bottom surface of the dielectric layer 351 and the antenna area 352 may be formed on the top surface of the dielectric layer 351. In the internal stack state of the display 300 illustrated in FIG. 21, the display panel 340, the mesh grids 322, the dielectric layer 351, the antenna area 352, and the glass 310 may be sequentially stacked. Alternatively, according to the embodiment of the present invention illustrated in FIG. 22, the antenna area 352 may be patterned on the bottom surface of the dielectric layer 351 and the mesh grids 22 may be patterned on the top surface of the dielectric layer 351. In the internal stack state of the display 300 illustrated in FIG. 22, the display panel 340, the antenna pattern, the dielectric layer 351, the mesh grids 322, and the glass 310 may be sequentially stacked.

FIGS. 23 to 26 illustrate embodiments of a display 300 in which an antenna area 352 is formed on a glass 310 and a touch panel 320 is disposed under the glass 310 according to various embodiments of the present invention.

Referring to FIGS. 23 to 26, the antenna device 350 is stacked on the touch panel 320 in the display 300. The antenna device 350, for example the antenna area 352, is defined on the glass 310. In other words, the display 300 may be configured so that the display panel 340, the touch panel 320, and the glass 310 may be stacked sequentially and the antenna area 352 may be formed on the top or bottom surface of the glass 310.

Figure 23:
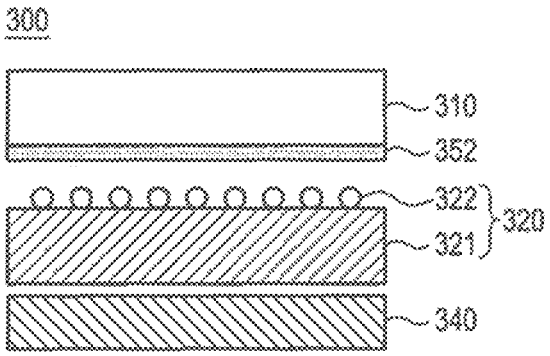
FIG. 23 illustrates a display in which an antenna area is provided on a glass and a touch panel is stacked under the glass according to an embodiment of the present invention.
Figure 24:
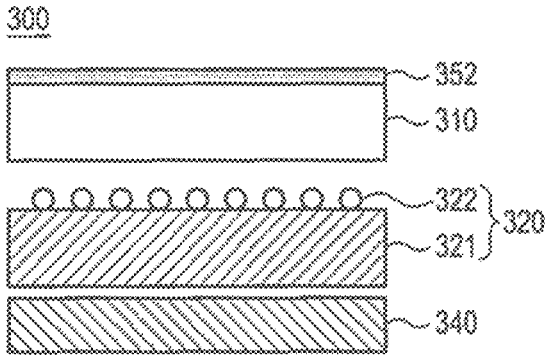
FIG. 24 illustrates a display in which an antenna area is provided on a glass and a touch panel is stacked under the glass according to an embodiment of the present invention.

In the embodiments of the present invention illustrated in FIGS. 23 and 24, the touch panel 320 may be stacked on the display panel 340. Compared to the embodiments of the present invention described below, the mesh grids 322 are formed on the top surface of the conductive film member 321 in the touch panel 320 according to embodiments of the present invention. The glass 310 may be stacked on the touch panel 320 having the mesh grids 322 on the conductive film member 321. The antenna area 352 may be patterned on the bottom surface of the glass 310 as in the embodiment of the present invention illustrated in FIG. 23. In the stack structure of the display 300 according to the embodiment of the present invention illustrated in FIG. 23, the display panel 340, the conductive film member 321, the mesh grids 322, the antenna area 352, and the glass 310 may be provided sequentially. As in the embodiment of the present invention illustrated in FIG. 24, the antenna area 352 may be patterned on the top surface of the glass 310. In the stack structure of the display 300 according to the embodiment of the present invention illustrated in FIG. 24, the display panel 340, the conductive film member 321, the mesh grids 322, the glass 310, and the antenna area 352 may be provided sequentially.

Figure 25:
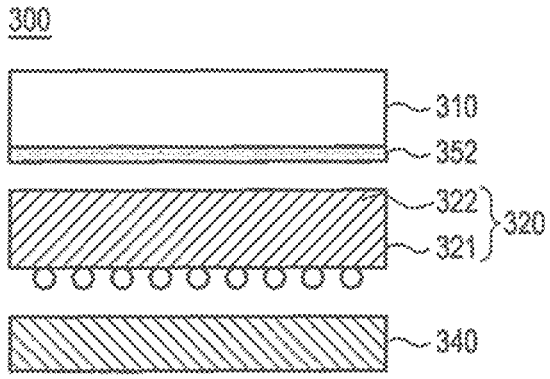
FIG. 25 illustrates a display in which an antenna area is provided on a glass and a touch panel is stacked under the glass according to an embodiment of the present invention.
Figure 26:
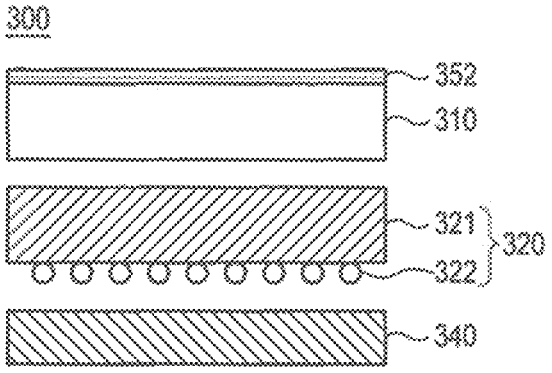
FIG. 26 illustrates a display in which an antenna area is provided on a glass and a touch panel is stacked under the glass according to an embodiment of the present invention.

In the embodiments of the present invention illustrated in FIGS. 25 and 26, the touch panel 320 may be stacked on the display panel 340. The embodiments of the present invention illustrated in FIGS. 25 and 26 differ from the embodiments of the present invention illustrated in FIGS. 23 and 24 in that the mesh grids 322 are provided on the bottom surface of the conductive film member 321 in FIGS. 25 and 26. The glass 310 may be stacked on the touch panel 320 having the mesh grids 322 on the bottom surface of the conductive film member 321. The antenna area 352 may be patterned on the bottom surface of the glass 310 as in the embodiment of present invention illustrated in FIG. 25, whereas the antenna area 352 may be patterned on the top surface of the glass 310 as in the embodiment of present invention illustrated in FIG. 26. In the stack structure of the display 300 according to the embodiment of the present invention illustrated in FIG. 25, the display panel 340, the mesh grids 322, the conductive film member 321, the antenna area 352, and the glass 310 may be provided sequentially. In the stack structure of the display 300 according to the embodiment of the present invention illustrated in FIG. 26, the display panel 340, the mesh grids 322, the conductive film member 321, the glass 310, and the antenna area 352 may be provided sequentially.

FIGS. 27 and 28 illustrate embodiments of a display 300 in which mesh grids 322 are provided on a glass 310 and an antenna device 350 is provided under the glass 310 having the mesh grids 322 according to various embodiments of the present invention.

Referring to FIGS. 27 and 28, the display panel 340, the dielectric layer 351 having the antenna pattern 352, and the glass 310 may be stacked sequentially, and the mesh grids 322 may be formed on the top or bottom surface of the glass 310 in the display 300.

For example, the dielectric layer 351 having the antenna area 352 may be formed on the display panel 340. The glass 310 having the mesh grids 322 may be provided on the dielectric layer 351. While the mesh grids 322 are described as patterned on the bottom surface of the glass 310 according to an embodiment of the present invention by way of example, the mesh grids 322 may be patterned on the top surface of the glass 310 depending on the structure or configuration of the display 300. According to the embodiment of the present invention illustrated in FIG. 27, the antenna area 352 may be patterned on the top surface of the dielectric layer 351. Accordingly in the stack structure of the display 300 according to the embodiment of the present invention illustrated in FIG. 27, the display panel 340, the dielectric layer 351, the antenna area 352, the mesh grids 322, and the glass 310 may be stacked sequentially. According to the embodiment of the present invention illustrated in FIG. 28, the antenna area 352 may be patterned on the bottom surface of the dielectric layer 351. Accordingly in the stack structure of the display 300 according to the embodiment of the present invention illustrated in FIG. 28, the display panel 340, the antenna area 352, the dielectric layer 351, the mesh grids 322, and the glass 310 may be stacked sequentially.

FIGS. 29 and 30 illustrate embodiments of a display in which a touch panel 320 has an OCTA panel 321*a* and an antenna device 350 is stacked along with the touch panel 320 according to an embodiment of the present invention.

Referring to FIGS. 29 and 30, the touch panel 320 may include an OCTA panel 321*a* and the mesh grids 322 on the OCTA panel 321*a* according to an embodiment of the present invention.

The antenna device 350 may be stacked along with the touch panel 320 in the display 300 in the structures illustrated in FIGS. 29 and 30.

As in the embodiment of the present invention illustrated in FIG. 29, the antenna device 350 may include the dielectric layer 351 on the OCTA panel 321*a* having the mesh grids 322 formed on it, and the antenna area 352 may be formed on the top surface of the dielectric layer 351. Accordingly, in the stack structure of the display 300 according to the embodiment of the present invention illustrated in FIG. 29, the display panel 340, the OCTA panel 321*a*, the mesh grids 322, the dielectric layer 351, the antenna area 352, and the glass 310 may be stacked sequentially.

As in the embodiment of the present invention illustrated in FIG. 30, the antenna device 350, for example the antenna area 352, may be formed on at least one surface of the glass 310. In other words, the antenna area 352 may be provided on the top or bottom surface of the glass 310. While the antenna area 352 is described as formed on the bottom surface of the glass 310 in an embodiment of the present invention by way of example, the antenna area 352 may be formed on the top surface of the glass 310. Accordingly, in the stack structure of the display 300 according to the embodiment of the present invention illustrated in FIG. 30, the display panel 340, the OCTA panel 321*a*, the mesh grids 322, the antenna area 352, and the glass 310 may be stacked sequentially.

FIGS. 31, 32, and 33 illustrate embodiments of a display 300 in which an antenna area 352 and mesh grids 322 are formed on the same plane according to various embodiments of the present invention.

Referring to FIGS. 31, 32, and 33, the antenna area 352 and the mesh grids 322 may be provided on the same plane, for example, on the top or bottom surface of the dielectric layer as illustrated in FIG. 31, on the top or bottom surface of the glass 310 as illustrated in FIG. 32, or on one surface of the OCTA panel 321*a* as illustrated in FIG. 33. The description of FIGS. 5 and 6 may be referred to for a structure in which the antenna area 352 and the mesh grids 322 are provided together.

Referring to FIG. 31, the dielectric layer 351 may be stacked between the display panel 340 and the glass 310, and the antenna area 352 and the mesh grids 322 may be provided together on the top or bottom surface of the dielectric layer 351.

Referring to FIG. 32, the glass 310 may be stacked on the display panel 340 and the mesh grids 322 and the antenna area 352 may be provided together on at least one surface of the glass 310. While the antenna area 352 and the mesh grids 322 are described as provided on the bottom surface of the glass 310 in an embodiment of the present invention, the mesh grids 322 may be positioned on the top surface of the glass 310.

Referring to FIG. 33, one OCTA panel 321*a* may be stacked between the display panel 340 and the glass 310. The antenna area 352 and the mesh grids 322 may be provided together on at least one surface of the OCTA panel 321*a*.

FIG. 34 is a schematic view illustrating an antenna device according to one of various embodiments of the present invention. FIGS. 35 to 40 illustrate various antenna patterns for an antenna device according to various embodiments of the present invention.

Referring to FIGS. 34 to 40, the antenna area 352 may include the antenna area 352, the conductive area 354, and the dielectric area 353. While the following description is given with the appreciation that the antenna area 352 is defined on the dielectric layer 351, by way of example, the antenna area 352 may be formed at various positions on a panel stacked in the display 300, other than the dielectric layer 351, as stated above.

The antenna area 352 may include a radiator 352*a*, a power supply 352*b*, and a ground 352*c*.

Figure 35:
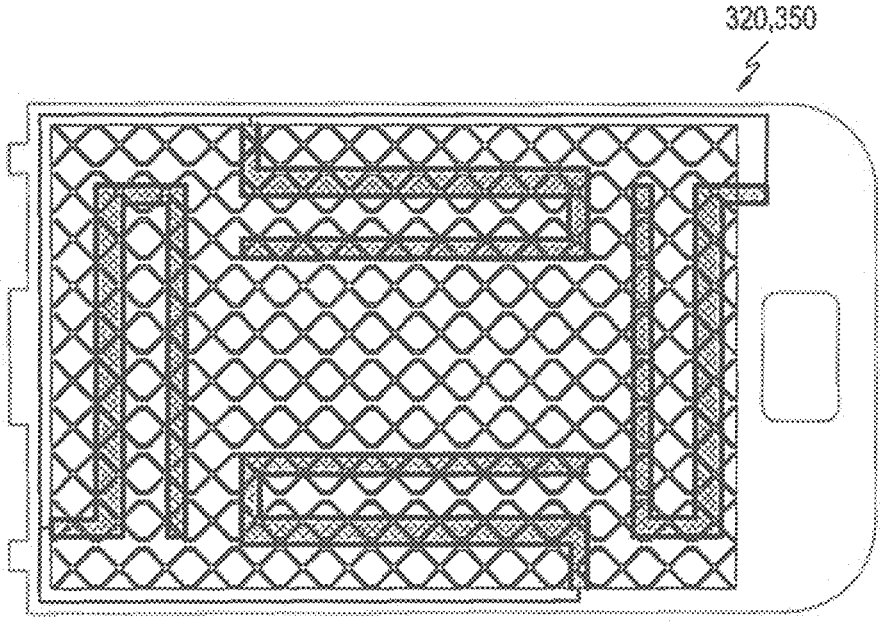
FIGS. 35 to 40 illustrate various antenna patterns for an antenna device according to various embodiments of the present invention.
Figure 36:
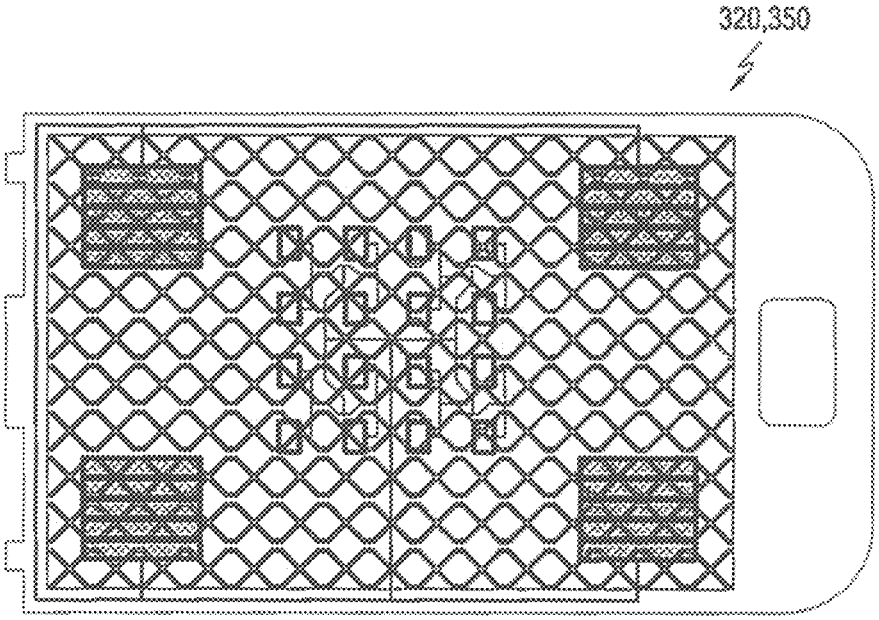
Figure 37:
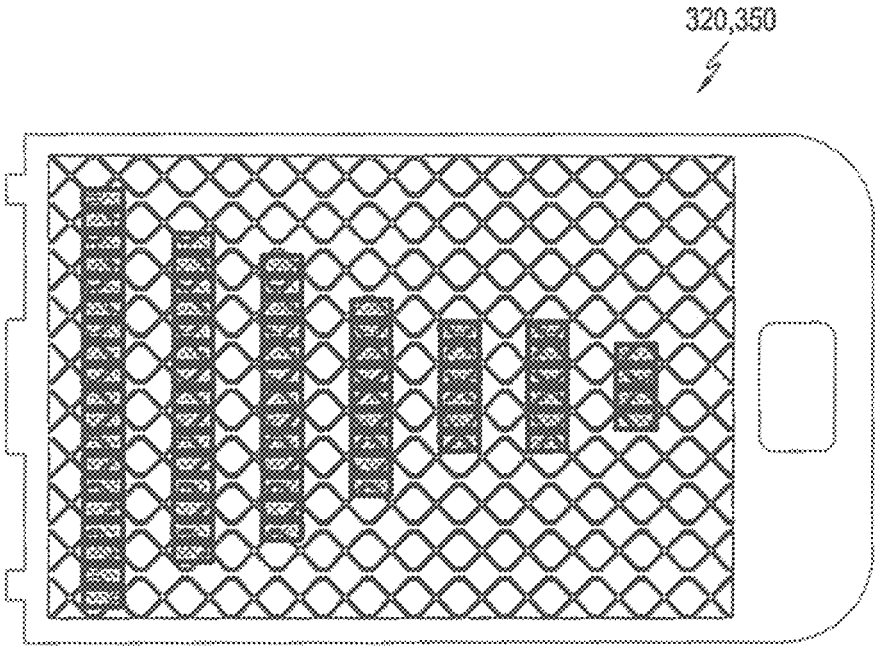
Figure 38:
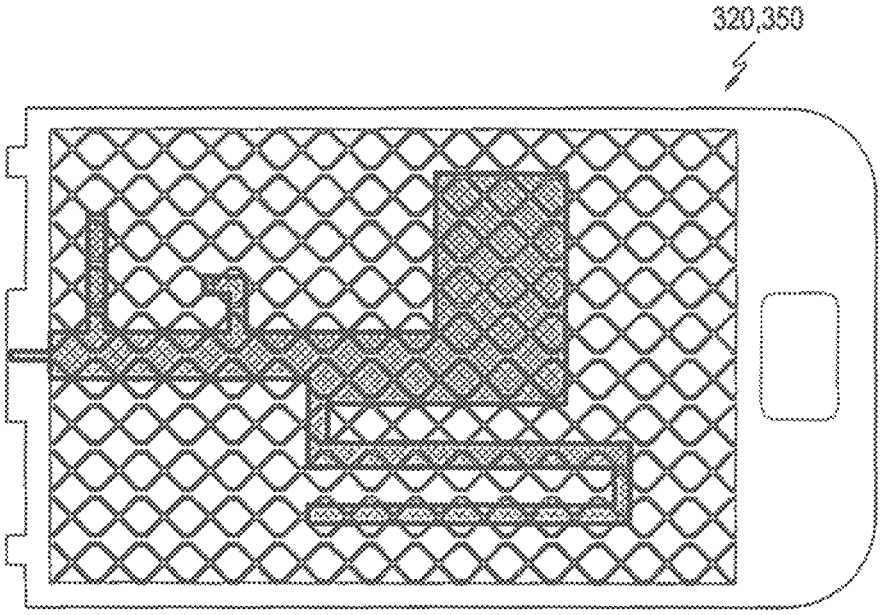
Figure 39:
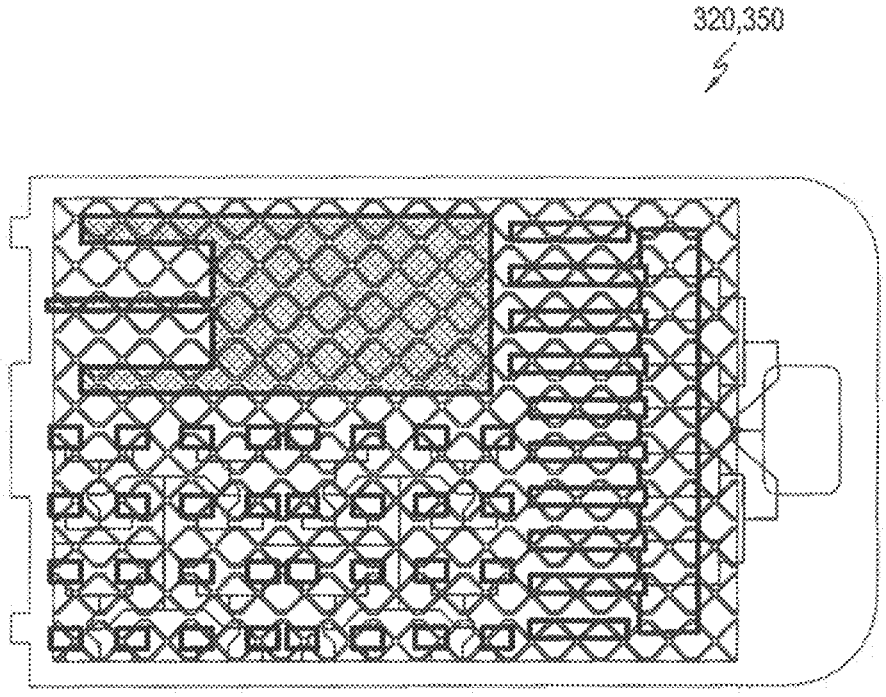
Figure 40:
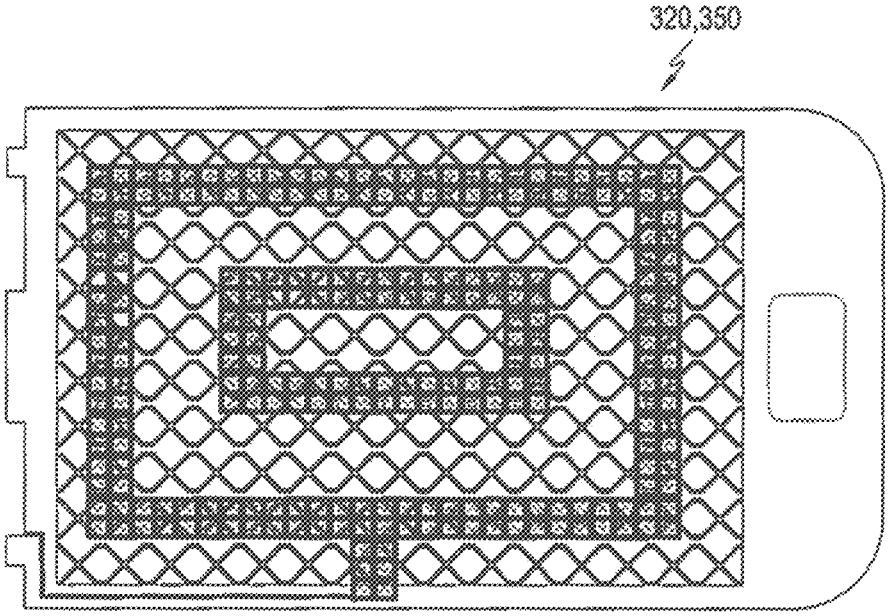

The radiator 352*a* may include a plurality of conductive grids, for resonation in a predetermined frequency band. The radiator 352*a* may have a plurality of patterns on the dielectric layer 351 or a panel having the antenna area 352 on it in order to provide a plurality of different communication services. For example, the radiator 352*a* may be configured to operate in MIMO as illustrated in FIG. 35, may be configured as sub-arrays for beam scanning as illustrated in FIG. 36, or may have antennas in arrays for radiation in the form of an end fire array antenna as illustrated in FIG. 37. Alternatively, the radiator 352*a* may be configured to have a 5G pattern, a WiFi pattern, and a millimeter Wave (mmWave) pattern, as illustrated in FIGS. 38 and 39. Furthermore, the radiator 352*a* may include a loop antenna for wireless charging, as illustrated in FIG. 40.

Figure 41:
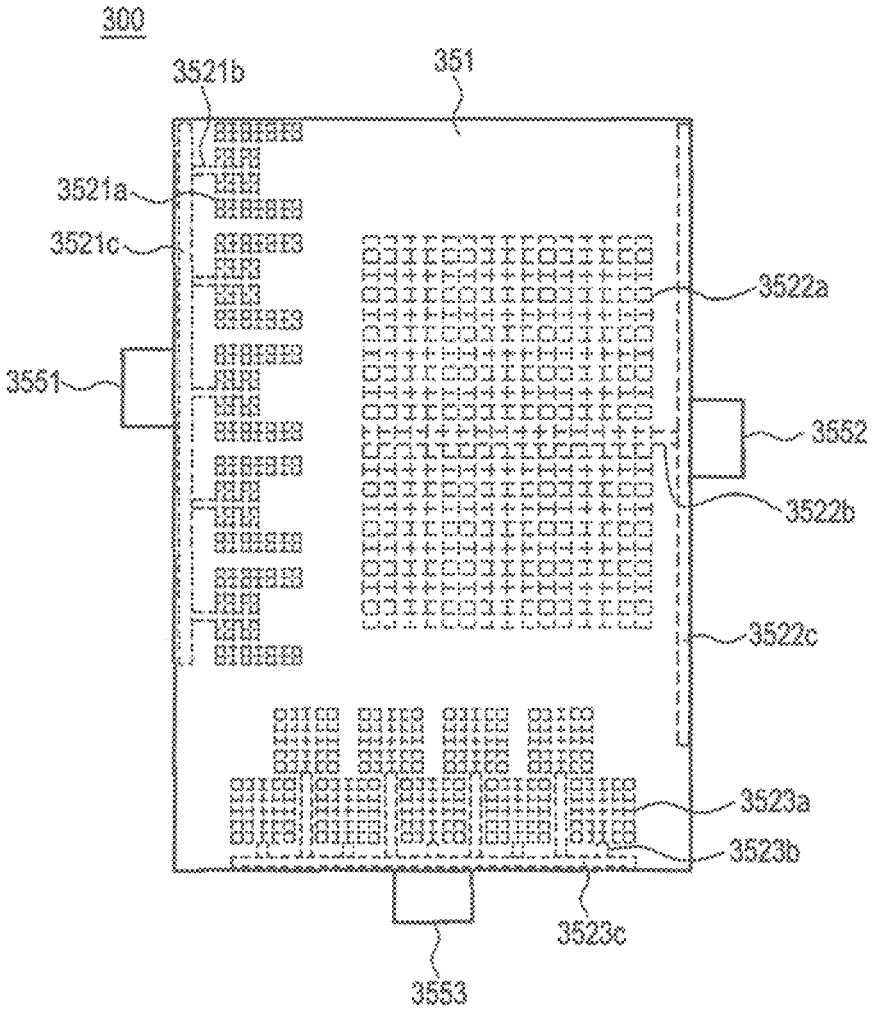
FIG. 41 illustrates an antenna device having a plurality of separately deployed radiator units according to an embodiment of the present invention.

The radiator 352*a* having the various radiating patterns may separate the radiating patterns from one another or interconnect them through the power supply 352*b*, depending on the structure of the power supply 352*b*. For example, if the radiators of 5G, WiFi, and mmWave patterns are provided by the radiator 352*a* on the dielectric layer 351, the 5G-pattern radiator, the WiFi-pattern radiator, and the mmWave-pattern radiator may be formed separately in the radiator 352*a* on the dielectric layer 351 as illustrated in FIG. 41). One power supply 352*b* may be provided to each separate radiator type to supply power to the radiator 352*a* as illustrated in FIG. 42.

Alternatively, if the radiators of 5G, WiFi, and mmWave patterns are provided by the radiator 352*a* on the dielectric layer 351, the 5G-pattern radiator, the WiFi-pattern radiator, and the mmWave-pattern radiator may be interconnected by conductive grids that form power supply lines. In other words, the single power supply 352*b* may supply power to the 5G-pattern radiator, the WiFi-pattern radiator, and the mmWave-pattern radiator through power supply lines connected to the radiator 352*a*.

Figure 42:
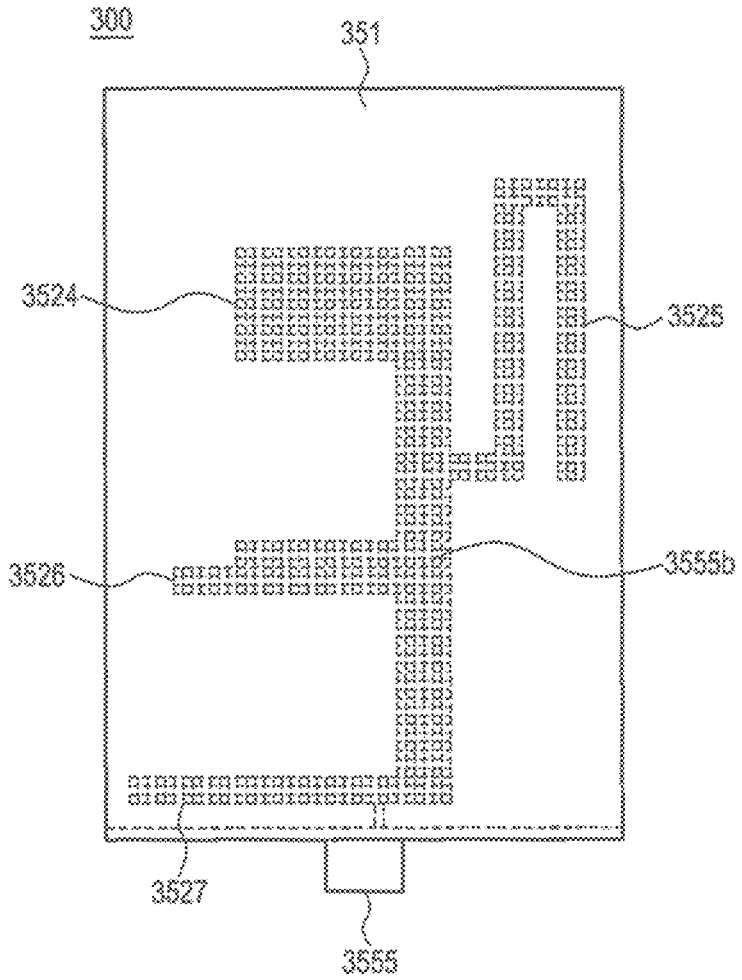
FIG. 42 illustrates an antenna device having a plurality of interconnected radiator units according to an embodiment of the present invention.

FIG. 41 illustrates an antenna device having a plurality of separate radiators formed in the radiator 352*a* according to an embodiment of the present invention and FIG. 42 illustrates an antenna device having a plurality of interconnected radiators according to an embodiment of the present invention.

The power supply 325*b* may be provided to supply power by connecting to the radiator 352*a* or by electrical coupling. The power supply 352*b* may include a plurality of power supply patterns 3521*b*, 3522*b*, and 3523*b* as illustrated in FIG. 41 or may be configured as a common power supply 3555*b* as illustrated in FIG. 42. If each radiator is connected to a corresponding power supply pattern as illustrated in FIG. 41, for example, radiators 3521*a* of a 5G pattern, radiators 3522*a* of a WiFi pattern, and radiators 3523*a* of a mmWave pattern are formed on the dielectric layer 351, the 5G-pattern radiators 3521*a*, the WiFi-pattern radiators 3522*a*, and the mmWave-pattern radiators 3523*a* may be apart from one another on the dielectric layer 351.

Further, power supply patterns 3521*b*, 3522*b*, and 3523*b* may be connected to the radiators 3521*a*, 3522*a*, and 3523*a*, respectively, and may be connected to respective connector tails 3551, 3552, and 3553 through grounds 3521*c*, 3522*c*, and 3523*c*.

If each radiator is connected to one common power supply 352*b* as illustrated in FIG. 42, for example, a WiFi-pattern radiator 3524, a 5G-pattern radiator 3525, an mmWave-pattern radiator 3526, and a Long Term Evolution pattern (LTE-pattern) radiator 3527 may be separated from one another on the dielectric layer 351.

A common power supply 3555*b* may be connected commonly to the radiators 3524, 3525, 3526, and 3527. The common power supply 3555*b* may be connected to a connector tail 3555 through a common ground.

Figure 43:
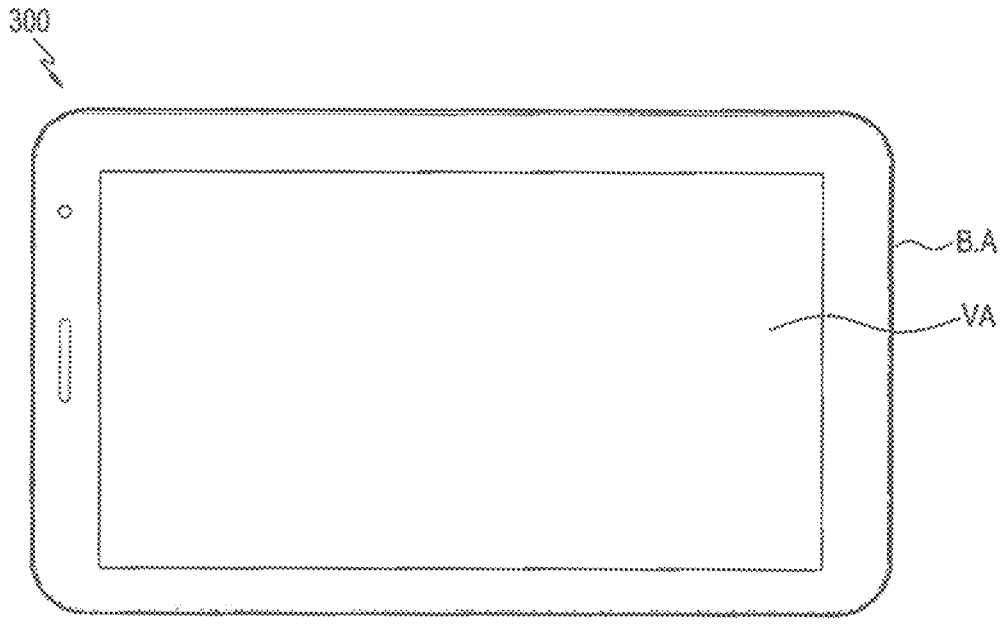
FIG. 43 illustrates a display according to an embodiment of the present invention.

FIG. 43 illustrates a display according to an embodiment of the present invention and FIG. 14 illustrates a VA and a BA in a display according to an embodiment of the present invention.

Figure 44:
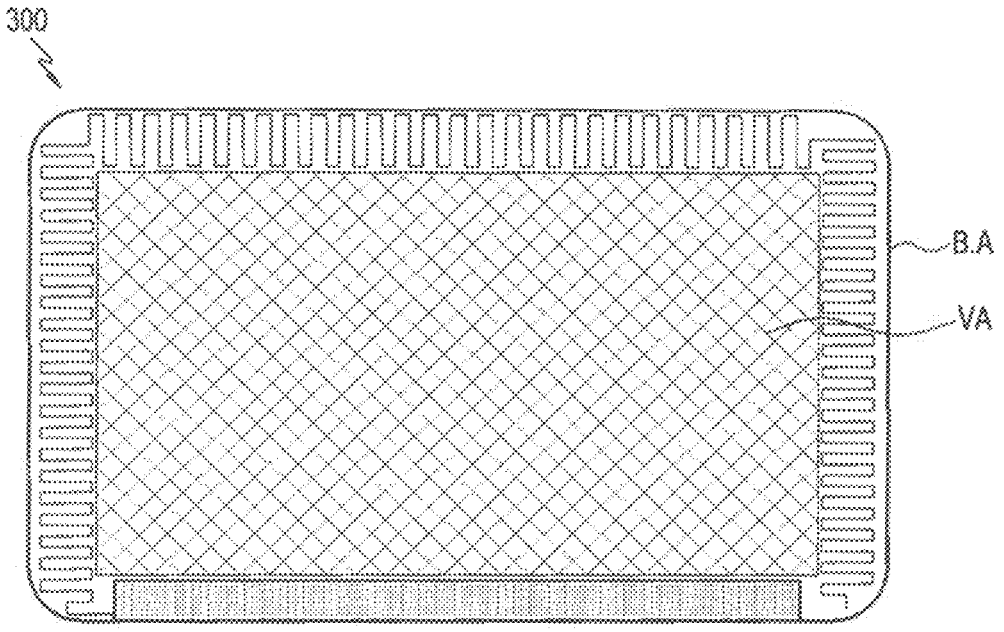
FIG. 44 is a schematic view illustrating interiors of a View Area (VA) and a Bezel Area (BA) of a display according to an embodiment of the present invention.

Referring to FIGS. 43 and 44, the display 300 may include a VA in which a screen is displayed and a BA in which a connector tail, a transmission line, or a connection line is installed to supply power to the touch panel 320 or the display panel 340 stacked around the VA. A connector tail or a transmission line for supplying power to the radiator 352*a* may be provided in the BA, not in the VA. Thus, loss of a signal transmitted from one radiator in the radiator 352*a* to another radiator in the radiator 352*a* may be reduced.

Figure 45:
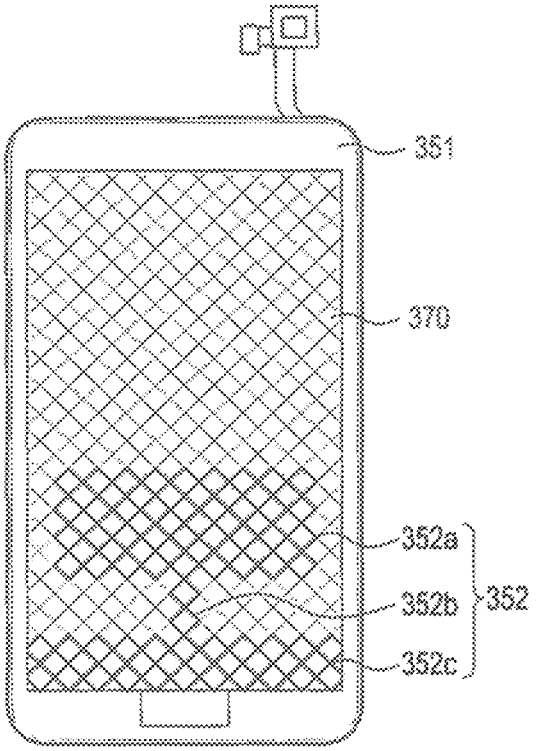
FIGS. 45 and 46 illustrate dummy grids for an antenna device according to an embodiment of the present invention.
Figure 46:
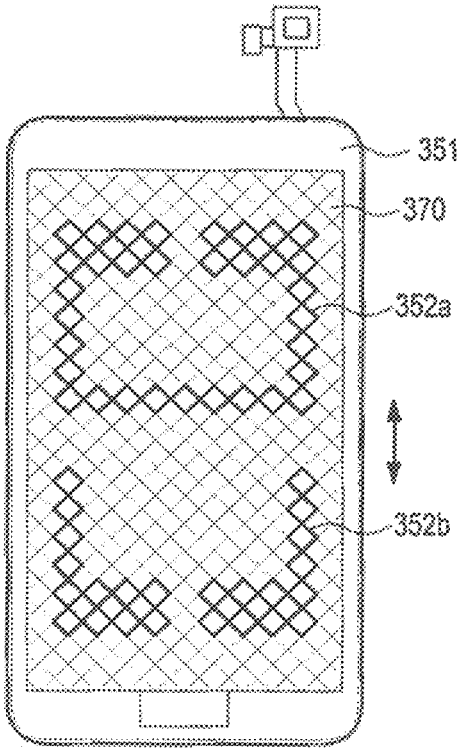

FIGS. 45 and 46 illustrate dummy grids for an antenna device according to an embodiment of the present invention.

Referring to FIGS. 45 and 46, the antenna area 352 may be provided on the dielectric layer 351. As described above, the antenna area 352 includes a plurality of conductive grids. In a similar manner to a manner described above with reference to FIGS. 4 and 5, the antenna area 352 may be formed by removing a part of the conductive grids including transparent wires and electrodes into the patterns of radiators of the radiator 352*a*. In this case, the antenna area 352, the dielectric area 353 is free of conductive grids, and the conductive area 354 apart from the antenna area 352 may be defined on the dielectric layer 351.

In this case, the dielectric area 353 free of conductive grids may be confined within a range that does not decrease visibility.

Alternatively, the radiator 352*a* and the power supply 352*b* may be formed by conductive grids as the antenna area 352 on one surface of the dielectric layer 351. In this case, the dielectric layer 351 may be divided into the antenna area 352 and the dielectric area 353.

If the dielectric layer 351 is stacked in the display 300, the dielectric area 353 may generate a shadowing area. To mitigate the decrease in visibility caused by the shadowing of the dielectric layer 353, dummy grids 370 may be formed.

The dummy grids 370 may be formed directly on the surface of the dielectric layer 351 or may be formed on an additional panel which is then stacked on the top or bottom surface of the dielectric layer 351.

If the dummy grids 370 are formed apart from the antenna area 352 by a predetermined distance on the dielectric layer 351, the dummy grids 370 may form a ground of the antenna area 352 by the conductive area 354. If a plurality of patterns is formed as the antenna area 352 on one surface of the dielectric layer 351, the dummy grids 370 may isolate one radiator in the radiator 352*a* from another radiator in the radiator 352*a*.

As is apparent from the foregoing description of an antenna device and an electronic device according to various embodiments of the present invention, a plurality of radiation patterns may be readily realized by forming radiation patterns on a conductive film member built in a display.

Since the antenna device is built in the display, an installation space of the antenna device can be secured. Due to an antenna pattern formed in the display, data transmission can be performed in radio frequencies of various areas according to radiation patterns and their settings.

Further, as radiation patterns are built in the display, a radio signal may be radiated forward from an electronic device having a large display. Accordingly, stable transmission and reception performance, a high gain, and a wide radiation coverage can be secured in an electronic device installed at a fixed location, such as a TV.

Since a plurality of antenna devices can be mounted in an electronic device, transmission and reception can be performed in various radio frequency bands and wireless data transmission and reception speeds can be increased.

In addition, since a touch panel or an additional conductive film member can be stacked in the display, the installation space of an antenna can be readily secured in an electronic device. If a phase difference-based power supply is implemented for a plurality of radiation members, electrical beam steering is possible. Accordingly, a stable gain and a wide radiation coverage can be secured even in an ultra high frequency band of tens of GHz or higher.

While the present invention has been shown and described with reference to embodiments thereof, it will be understood by those skilled in the art that various changes in form and details may be made therein without departing from the scope and spirit of the present invention, as defined by the appended claims and their equivalents.

What is claimed is:

1. An electronic device having an antenna device, comprising:

a display including a touch panel, wherein the touch panel comprises a conductive film member including mesh grid areas formed by transparent wires and electrodes, and at least one radiation pattern path, wherein the at least one radiation pattern path is formed to be separate from the mesh grid areas, wherein, by removing a part of the mesh grid areas, the at least one radiation pattern path is formed to be surrounded by a remaining part of the mesh grid areas, and wherein at least a portion of the at least one radiation path is configured to correspond to a shape of the removed part of the mesh grid areas.

2. The electronic device of claim 1, further comprising:

a substrate provided at an edge of the display;

a power supply mounted on the substrate for applying a signal current to the radiation pattern path; and a transmission line configured to connect the radiation pattern path to the power supply.

3. The electronic device of claim 1, wherein the radiation pattern path is formed into at least one antenna including a slot antenna, a loop antenna, a patch antenna, a monopole antenna, and a dipole antenna.

4. The electronic device of claim 1, wherein an operating frequency is determined according to a width of the radiation pattern path between the mesh grid areas, a distance from another radiation pattern path, and a path length of the radiation pattern path.

5. The electronic device of claim 1, wherein the conductive film member includes an Indium Tin Oxide (ITO) panel.

6. An electronic device having an antenna device configured in a display, the antenna device comprising:

a dielectric layer provided in the display;

an antenna area formed on a front or rear surface of the dielectric layer for transmitting or receiving electromagnetic waves through a first plurality of conductive grids;

a conductive area disposed apart from the antenna area by a predetermined distance on a plane on which the antenna area is formed and including a second plurality of conductive grids;

a dielectric area disposed between the antenna area and the conductive area for separating the antenna area from the conductive area by the predetermined distance by removing at least a portion of the second plurality of conductive grids; and a touch panel disposed on a different plane from the plane on which the antenna area and the conductive area are positioned, wherein at least a portion of the antenna area is formed between the second plurality of conductive grids of the conductive area, and wherein, by removing the at least a portion of the second plurality of conductive grids, at least a portion of the first plurality of conductive grids is formed to be surrounded by a remaining part of the second plurality of conductive grids.

7. The electronic device of claim 6, wherein the touch panel is disposed on a front or rear surface of the dielectric layer.

8. The electronic device of claim 6, wherein the antenna device further comprises:

a display panel disposed under the dielectric layer; and a glass disposed either on or under the dielectric layer.

9. The electronic device of claim 6, wherein the antenna area comprises:

a radiator including the plurality of conductive grids for resonating in a predetermined frequency band; and a power supply configured to supply power by connecting to the radiator or by electrical coupling.

10. The electronic device of claim 9, wherein the radiator includes a plurality of patterns to provide a plurality of different communication services, and the power supply comprises a plurality of power supply patterns to supply power to the plurality of patterns or a single common power supply to supply power commonly to the plurality of patterns.

11. The electronic device of claim 9, wherein the radiator includes an antenna array, for Multiple Input Multiple Output (MIMO) or beam scanning.

12. The electronic device of claim 6, wherein the antenna device further comprises a dummy grid on a surface of the dielectric layer on which the antenna area is formed or on a front or rear surface of the dielectric layer.

* * * * *